US007556902B2

(12) United States Patent
Shoshi

(10) Patent No.: US 7,556,902 B2
(45) Date of Patent: Jul. 7, 2009

(54) AROMATIC POLYESTER RESIN, AND ELECTROPHOTOGRAPHIC PHOTOCONDUCTOR AND IMAGE FORMING APPARATUS USING THEREOF

(75) Inventor: Masayuki Shoshi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 393 days.

(21) Appl. No.: 11/209,755

(22) Filed: Aug. 24, 2005

(65) Prior Publication Data

US 2006/0046169 A1 Mar. 2, 2006

(30) Foreign Application Priority Data

Aug. 27, 2004 (JP) ..... 2004-247743
Dec. 6, 2004 (JP) ..... 2004-352595

(51) Int. Cl.
*G03G 5/05* (2006.01)

(52) U.S. Cl. ..... 430/59.6; 430/66; 430/96; 399/159

(58) Field of Classification Search ..... 430/58.7, 430/58.25, 96, 66, 59.6; 399/159
See application file for complete search history.

(56) References Cited

U.S. PATENT DOCUMENTS 4,801,517 A 1/1989 Frechet et al.

(Continued)

FOREIGN PATENT DOCUMENTS

JP 56-135844 10/1981

(Continued)

OTHER PUBLICATIONS

U.S. Appl. No. 10/943,262, filed Sep. 17, 2004, Arizumi et al.

(Continued)

*Primary Examiner*—John L Goodrow
(74) *Attorney, Agent, or Firm*—Oblon, Spivak, McClelland, Maier & Neustadt, P.C.

(57) ABSTRACT

The object of the invention is to provide a novel aromatic polyester resin useful as a binder resin or charge transporting polymer for an organic photoconductor and an electrophotographic photoconductor having high sensitivity and high durability produced using the above-noted novel aromatic polyester resin. For this object, the invention provides an aromatic polyester resin which has a recurring unit represented by the following Formula (I) and an electrophotographic photoconductor produced using the above-noted aromatic polyester resin.

Formula (I)

wherein $R^1$ represents any one of a hydrogen atom, an unsubstituted or substituted alkyl group and an unsubstituted or substituted aryl group; $Ar^1$ represents an unsubstituted or substituted aryl group; $Ar^2$ and $Ar^3$ may be the same as or different from each other and represent respectively an unsubstituted or substituted arylene group; and W represents an unsubstituted or substituted divalent aromatic group.

23 Claims, 6 Drawing Sheets

U.S. PATENT DOCUMENTS

| | | | | |
|---|---|---|---|---|
| 4,806,443 | A | 2/1989 | Yanus et al. | |
| 4,806,444 | A | 2/1989 | Yanus et al. | |
| 4,937,165 | A | 6/1990 | Ong et al. | |
| 4,959,288 | A | 9/1990 | Ong et al. | |
| 5,030,532 | A | 7/1991 | Limburg et al. | |
| 5,034,296 | A | 7/1991 | Ong et al. | |
| 5,072,043 | A | 12/1991 | Shoshi et al. | |
| 5,080,989 | A | 1/1992 | Gruenbaum et al. | |
| 5,492,784 | A | 2/1996 | Yoshikawa et al. | |
| 5,700,614 | A | 12/1997 | Kawahara et al. | |
| 5,750,762 | A | 5/1998 | Kawahara et al. | |
| 5,942,362 | A | 8/1999 | Tadokoro et al. | |
| 6,068,956 | A | 5/2000 | Namba et al. | |
| 6,074,792 | A | 6/2000 | Namba et al. | |
| 6,465,648 | B1 | 10/2002 | Tadokoro et al. | |
| 6,544,701 | B2 | 4/2003 | Tadokoro et al. | |
| 6,849,367 | B2 | 2/2005 | Shoshi et al. | |
| 2005/0106483 | A1* | 5/2005 | Shoshi et al. | 430/58.7 |

FOREIGN PATENT DOCUMENTS

| | | |
|---|---|---|
| JP | 64-9964 | 1/1989 |
| JP | 2-304456 | 12/1990 |
| JP | 3-6567 | 1/1991 |
| JP | 3-221522 | 9/1991 |
| JP | 4-11627 | 1/1992 |
| JP | 4-18371 | 1/1992 |
| JP | 4-31404 | 2/1992 |
| JP | 4-133065 | 5/1992 |
| JP | 4-175337 | 6/1992 |
| JP | 7-300434 | 11/1995 |
| JP | 7-333911 | 12/1995 |
| JP | 10-133400 | 5/1998 |
| JP | 10-310635 | 11/1998 |
| JP | 11-29634 | 2/1999 |
| JP | 2958100 | 7/1999 |
| JP | 2000-63456 | 2/2000 |
| JP | 2002-40677 | 2/2002 |
| JP | 2002-116560 | 4/2002 |
| JP | 2002-131943 | 5/2002 |
| JP | 2002-214610 | 7/2002 |
| JP | 3368415 | 11/2002 |
| JP | 2002-351101 | 12/2002 |
| JP | 2003-5391 | 1/2003 |
| JP | 2003-57856 | 2/2003 |
| JP | 3583707 | 8/2004 |

OTHER PUBLICATIONS

Milan Stolka, et al., "Photoconductivity and Hole Transport in Polymers of Aromatic Amine-Containing Methacrylates", Journal of Polymer Science: Polymer Chemistry Edition, vol. 21, 1983, pp. 969-983.

Tomohisa Gotoh, et al, "Hole Transport Properties of Polymers containing a hydrazono group", Opto-Electronics Res. Labs. Nec Corp., 1989, pp. 67-70.

M. A. Abkowitz, et al., "Electronic transport in a model tetraphenylbenzidine main-chain polymer: Direct Comparison of time-of flight hole drift mobility and electrochemical determinations of hole diffusion", Physical Review B, The American Physical Society, vol. 46, No. 11, Sep. 15, 1992, pp. 6705-6717.

* cited by examiner

AROMATIC POLYESTER RESIN, AND ELECTROPHOTOGRAPHIC PHOTOCONDUCTOR AND IMAGE FORMING APPARATUS USING THEREOF

BACKGROUND OF THE INVENTION

1. Field of the Invention

The present invention relates to an aromatic polyester resin having a transporting function and having a specific structure which is useful as a material for producing an electrophotographic photoconductor, to an electrophotographic photoconductor which comprises a photosensitive layer and outermost-surface layer comprising the aromatic polyester resin, which has high sensitivity and high durability and which is used for a dry or liquid developing; and to an image forming apparatus equipped with the photoconductor.

2. Description of the Related Art

An aromatic polyester resin produced by reacting 2,2-bis (4-hydroxyphenyl) propane (hereinafter referred to as "bisphenol A") with any one of isophthalic acid, terephthalic acid, isophthalic acid dichloride and terephthalic acid dichloride is known as a representative aromatic polyester resin (i.e., a polyarylate resin). Such an aromatic polyester resin produced from a bisphenol A is excellent in transparency, heat resistance, dimensional accuracy and mechanical strength and therefore is applied in various application fields.

Recently, an organic photoconductor (OPC) is frequently used in a copying machine and a printer. Examples of the representative layer composition of the organic photoconductor include a laminated layer composition in which a charge generating layer (CGL) and a charge transporting layer (CTL) are disposed on a support in this order. The charge transporting layer comprises a charge transporting material having a low molecular mass (CTM) and a binder resin and as the binder resin, an aromatic polycarbonate resin is frequently proposed. However, the low-molecular charge-transporting material tends to deteriorate inherent mechanical strength of the binder resin. As a result, the wear properties, scratch and cracking of the photoconductor are caused and the durability of the photoconductor is impaired.

On the other hand, aromatic polyester resins have been frequently studied with respect to application thereof as a binder resin used for the electrophotographic organic photoconductor. Representative examples of the layer composition of the organic photoconductor include a layer composition in which a charge transporting layer and a charge generating layer are disposed on the support in this order. The charge transporting layer comprises a low-molecular charge transporting material and a binder resin. Many examples are proposed, wherein aromatic polyester resins are used as the binder resin. For example, Japanese Patent Application Laid-Open (JP-A) No. 56-135844 discloses an electrophotographic photoconductor produced using an aromatic polyester resin which is commercially sold under the trade name "U-Polymer" as the binder resin. JP-A No. 3-6567 discloses an electrophotographic photoconductor comprising an aromatic polyester copolymer produced using a tetramethyl bisphenol F and a bisphenol A. Further, JP-A No. 7-333911 discloses an electrophotographic photoconductor produced using a bisphenol C.

However, in these proposals, by incorporating a charge transporting material having a low molecular mass in the composition of the charge transporting layer, the mechanical strength which the binder resin possesses originally is lowered. Accordingly, the wear properties of the photoconductor are impaired and the scratch and cracking of the photoconductor are caused, thus the durability of the photoconductor is impaired.

In old times, a photoconductor comprising a charge transporting complex, which comprises a vinyl polymer, such as polyvinyl anthracene, polyvinyl pyrene and poly-N-vinyl carbazole as a photo-electrical conductive polymer material is studied. However, the photosensitivity thereof was not satisfactory. On the other hand, a polymer material having a charge transporting function has been studied for improving the disadvantage of the above-noted photoconductor having a laminated layer composition. Examples of the above-noted polymer material having a charge transporting function which has been studied include an acrylic resin having a triphenylamine structure (see "M. Stolka et al, J. Polym. Sci., vol 21,969 (1983)"), a vinyl polymer having a hydrazone structure (see "Japan Hard Copy '89 P. 67"), a polycarbonate resin having a triarylamine structure (see U.S. Pat. Nos. 4,801,517, 4,806,443, 4,806,444, 4,937,165, 4,959,288, 5,030,532, 5,034,296, 5,080,989, JP-A Nos. 64-9964, 3-221522, 2-304456, 4-11627, 4-175337, 4-18371, 4-31404 and 4-133065), an aromatic polycarbonate resin having an α-phenylstilbene structure (see JP-A No. 11-29634), an aromatic polycarbonate resin having a carbazole structure (see Japanese Patent (JP-B) No. 2958100), an aromatic polycarbonate resin having an benzidine structure (see JP-A No. 64-9964) and an aromatic polycarbonate resin having a stilbene structure (see JP-B No. 3368415). However, none of these studied aromatic polycarbonate resins has been put into practice.

Further, M. A. Abkowitz et al have studied the comparison of a low-dispersed polycarbonate with a polymeric polycarbonate using a tetraarylbenzidine derivative as a model compound and as a result of the study, it was found that a polymeric polycarbonate had a drift mobility which is lower by one digit than that of a low-dispersed polycarbonate (see "Physical Review B46 6705 (1992)").

The cause thereof has been not yet clarified; however, the above result indicates that while by polymerizing the polycarbonate, the mechanical strength of the photoconductor is improved, the electrical properties of the photoconductor, such as the sensitivity and the residual potential are problematic.

The cause thereof has been also not yet clarified. However, it can be assumed that since in a polymer having a charge transportable skeleton in the main chain, particularly in a polycarbonate resin, by the effects of both an electron-attractive carbonyldioxy group which is substituted to an aryl group in a tetraarylbenzidine skeleton and an electron-donative tertiary amine group, electrons are localized and resultantly, the polymer has a disadvantage molecular structure for the electron-hole transfer. Therefore, it is considered that the above-noted disadvantage caused by polymerizing the polycarbonate is the cause of unsatisfactory electrical properties of the photoconductor, such as the sensitivity and residual potential.

On the other hand, a polyallylenevinylene resin is studied as a new attempt (see JP-A No. 10-310635).

Conventionally, the photo-electrical conductor as a material for the photoconductor used for the electrophotography is generally classified into an inorganic photo-electrical conductor and an organic photo-electrical conductor. Here, the "electrophotgraphy" means an image forming method (so-called "Carson Process") which comprises, generally, charging a photo-electrical conductive photoconductor by a corona discharge in the dark; exposing an image; scattering selectively the charge in only an exposed portion, thereby obtaining an electrostatic latent image; and developing and visualizing the portion of a latent image using a toner comprising a colorant, such as a dye and a pigment and a polymer material, thereby forming an image.

The developing method in the electrophotography according to the Carlson Process is generally classified into a dry developing method and a wet developing method (liquid developing method). The image forming apparatus using the dry developing method is applied at the present widely and generally to a copying machine, a printer and the like. On the other hand, the image forming apparatus using the wet developing method has been developed and commercialized from the old times. However, the market for the image forming apparatus is mostly shared by the image forming apparatus using the dry developing method.

However, with respect to the image forming apparatus using the wet developing method, generally, the toner is dispersed in a liquid and the toner particles can be rendered extremely fine, thus the obtained image can possess an extremely high image quality. Therefore, recently, accompanying with a market expansion for a full-color printer to which a high image quality is required, the image forming apparatus using the wet developing method is starting to attract the attention again and the development thereof is progressed.

Since, as noted above, the image forming apparatus using the wet developing method uses a developing liquid in which the toner particles are dispersed in a liquid, the whole part or a part of the used photoconductor is immersed in the above-noted liquid developing solution. Examples of the liquid (carrier solvent) used for the developing solution include an aliphatic hydrocarbon solvent, such as Isopar (trade name; manufactured by Exxon Chemicals Corporation) and a silicone oil. In addition, an inorganic photoconductor, such as selenium and amorphous silicone, by which a photoconductor component is not eluted into a carrier solvent is generally used.

On the other hand, a photoconductor comprising an organic photo-electrical conductor is advantageous, in comparison with a photoconductor comprising an inorganic photo-electrical conductor, in the degree of freedom in a wavelength region for the photoconductor, the film formation properties, the flexibility, the transparency of the film, the mass-productivity, the toxicity and the cost, thus the photoconductor comprising an organic material is actively developed and put into practice.

Such an organic photoconductor is generally classified into a laminated layer photoconductor comprising a charge generating layer having a charge generating function and a charge transporting layer having a charge transporting function; and a single layer photoconductor comprising a single layer having both the charge generating function and the charge transporting function. The former has a laminated layer composition in which a charge generating layer and a charge transporting layer are disposed on the support in this order and is applied, from a restriction with respect to an organic material, mainly to an image forming apparatus according to a negative charging system. The former is excellent in photosensitive properties and durability, thus is widely put into practice. On the other hand, the later has a single layer composition in which a photosensitive layer comprising a single layer is disposed on the support and is applied from the viewpoint of easiness in principle to obtain a high image resolution, mainly to an image forming apparatus according to a positive charging system.

Therefore, an inorganic photoconductor, such as selenium and amorphous silicone, which is generally used in an image forming apparatus using the above-noted wet developing method, is usually used by positive-charging the photoconductor, thus when an inorganic photoconductor which is previously used is replaced by an organic photoconductor, it is advantageous that an organic photoconductor in the single layer composition can be used in the same image forming apparatus according to the positive-charging system as that in which an inorganic photoconductor is previously used.

When a general organic photoconductor is used in an image forming apparatus according to a wet developing system, since as noted above, the whole or a part of used photoconductor is immersed in a liquid developing solution (carrier solvent), due to the cracking of the photoconductor caused by contacting the photoconductor with the carrier solvent, the crystallization of the compound having a low molecular mass, such as a charge transporting material and/or an acceptor compound, and the elusion of these compounds into the developing solution, the photoconductor is extremely deteriorated both mechanically and electrically, accordingly an advantageous image cannot be obtained.

Thus, conventionally proposed is an organic photoconductor produced by a method in which on the surface of an organic photoconductor, an overcoat layer (surface protective layer) comprising a thermosetting resin which is insoluble in a liquid developing solution, such as a silicone resin, an epoxy resin and a melamine resin is disposed. However, by disposing the overcoat layer, the sensitivity of the photoconductor is extremely impaired and a large disadvantage is newly caused wherein the production cost is elevated.

On the other hand, as a photoconductor produced by another method than the above-noted overcoat method, a photoconductor in a single layer composition which can be used in a wet developing system and which has such advantages by producing the photoconductor using a specific binder resin that the photoconductor has high resistance to a carrier solvent used in the wet developing system; a charge transporting material of the photoconductor is not eluted into the carrier solvent; and the photoconductor has a practical sensitivity, is disclosed (see JP-A Nos. 2002-116560, 2002-131943, 2002-351101, 2002-40677, 2002-214610 and 2003-5391).

However, in these proposals, since by using a binder resin having a relatively high polarity, the resistance of the photoconductor to a carrier solvent having a low polarity is improved, the elution of the charge transporting material into the carrier solvent is substantially inevitable, thus such a photoconductor is not durable to withstand sustained usage for a long term.

In JP-A No. 2000-63456, described are a copolymer between a chemical structure block having a charge transporting function and a chemical structure block of the binder resin; and a photoconductor in a single layer composition produced by using the above-noted copolymer. When this copolymer is used in an electrophotographic photoconductor according to a wet developing system, the elution of a compound having a low molecular mass of the photoconductor into a liquid developing agent can be prevented. However, such a photoconductor in a single layer composition does not always have a high sensitivity by which the photoconductor can satisfactorily satisfy the requirement of the market.

In JP-A No. 2003-57856, also described are a copolymer between a chemical structure block having a charge transporting function and a chemical structure block of the binder resin; and a photoconductor in a single layer composition produced by using the above-noted copolymer. However, since the copolymer comprises a chemical structure block having a charge transporting function in an amount of 5 mol % to 30 mol %, the charge transporting function is unsatisfactory. When only the copolymer assumes the charge transporting function, satisfactory sensitivity of the photoconductor cannot be obtained. Therefore, for obtaining satisfactory sensitivity, as shown in Examples, it becomes necessary that a charge transporting material having a low molecular mass is incorporated in the composition of the photosensitive layer of the photoconductor. When such a photoconductor is used as an electrophotographic photoconductor in a wet developing system, the elution of the charge transporting material having a low molecular mass into a liquid developing agent is inevitable and the photoconductor is not durable to withstand sustained usage for a long term.

Further, with respect to the wet developing system, in JP-B No. 3583707, proposed is an electrophotographic photoconductor produced using a polycarbonate resin having a specific structure as the binder resin and in JP-A No. 7-300434, proposed is an electrophotographic photoconductor comprising a 2,3-diphenylindene compound as an acceptor compound. Further, in JP-A No. 10-133400, proposed is an electrophotographic photoconductor comprising a bisphenolic compound having a specific structure as an anti-oxidant.

However, the polycarbonate resin described in JP-B No. 3583707 is a binder resin having no charge transporting function and the photoconductor produced using such a binder resin has the same problem as the above-noted problem. In JP-A Nos. 7-300434 and 10-133400, there is no description with respect to the aromatic polyester resin having a charge transporting function.

SUMMARY OF THE INVENTION

The object of the invention is to provide a novel aromatic polyester resin which is useful as a binder resin or charge transporting polymer which are used for producing an organic photoconductor.

Another object of the invention is to provide an electrophotographic photoconductor having high sensitivity and high durability produced by using an aromatic polycarbonate resin having the charge transporting function.

More another object of the invention is to provide an electrophotographic photoconductor in a single layer composition for a liquid developing which has high resistance to a carrier used in a liquid developing and has high sensitivity and which is practical.

The present inventors have made extensive and intensive studies. As a result, it has been found that the above-noted problem can be solved by an aromatic polyester resin having a specific composition unit or by both an electrographic photoconductor used for the dry developing and an electrographic photoconductor used for a liquid developing which comprise the above-noted polyester resin in a photosensitive layer or most outer surface layer thereof. Based on these novel findings, the invention has been completed.

The aromatic polyester resin according to the first aspect of the invention comprises a recurring unit represented by the following Formula (I):

Formula (I)

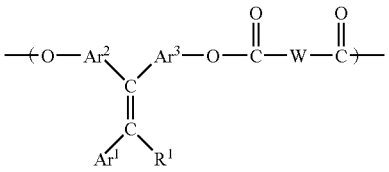

wherein $R^1$ represents any one of a hydrogen atom, an unsubstituted or substituted alkyl group and an unsubstituted or substituted aryl group; $Ar^1$ represents an unsubstituted or substituted aryl group; $Ar^2$ and $Ar^3$ may be the same as or different from each other, and represent individually an unsubstituted or substituted arylene group; and W represents an unsubstituted or substituted divalent aromatic group.

The aromatic polyester resin according to the second aspect of the invention comprises a recurring unit represented by the following Formula (III):

Formula (III)

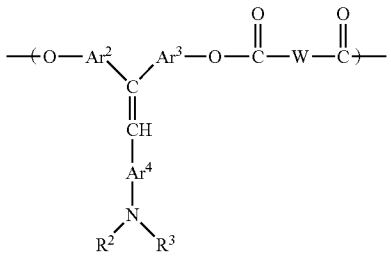

wherein $Ar^2$ and $Ar^3$ may be same as or different from each other, and represent individually an unsubstituted or substituted arylene group; W represents an unsubstituted or substituted divalent aromatic group; $Ar^4$ represents an unsubstituted or substituted arylene group; $R^2$ and $R^3$ may be the same as or different from each other, and represent individually any one of an acyl group, an unsubstituted or substituted alkyl group and an unsubstituted or substituted aryl group.

The aromatic polyester resin according to the third aspect of the invention comprises a recurring unit represented by the following Formula (IV):

Formula (IV)

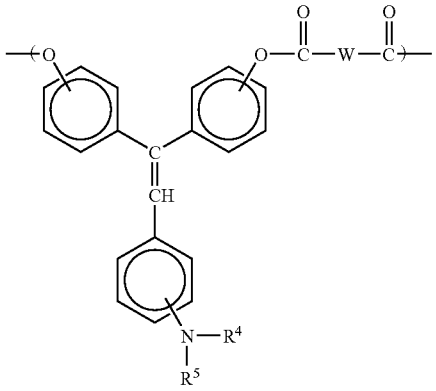

wherein $R^4$ and $R^5$ may be the same as or different from each other, and represent individually any one of an acyl group, an unsubstituted or substituted alkyl group and an unsubstituted or substituted aryl group; and W represents an unsubstituted or substituted divalent aromatic group.

The electrographic photoconductor according to the invention comprises a support and a photosensitive layer disposed on the support, wherein the photosensitive layer comprises any one of the aromatic polyester resins according to the first to third aspects of the invention.

The electrographic photoconductor for a liquid developing according to the invention comprises a support and a photosensitive layer in a single layer composition, which is disposed on the support directly or through an intermediate layer, wherein the photosensitive layer comprises a charge generating substance, a charge transporting material and an acceptor compound; and the charge generating substance comprises any one of the aromatic polyester resins according to the first to third aspects of the invention.

The image forming apparatus according to the invention comprises an electrophotographic photoconductor, an electrostatic-latent-image forming unit configured to form an electrostatic-latent image on the electrophotographic photoconductor, a developing unit configured to develop the electrostatic-latent image using a toner to form a visual image, a transferring unit configured to transfer the visual image to a recording medium, and a fixing unit configured to fix the image transferred to the recording medium, wherein the electrophotographic photoconductor is the electrophotographic photoconductor according to the invention.

Figure 1:
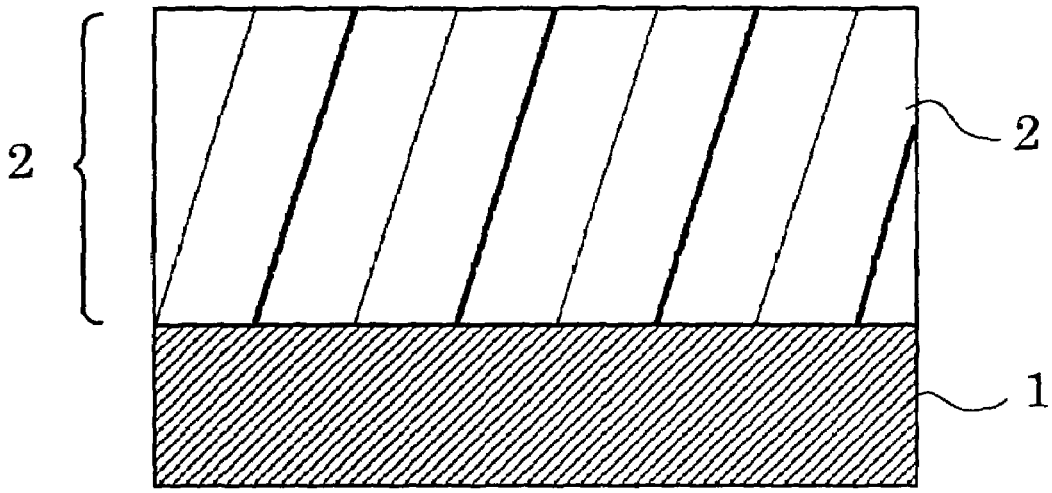
FIG. 1 is a cross sectional view schematically showing an example of the layer composition of the electrophotographic photoconductor according to the invention.

DESCRIPTION OF THE PREFERRED EMBODIMENTS (Aromatic Polyester Resin)

The aromatic polyester resin according to the invention comprises the charge transporting polymer comprising at least one selected from the group consisting of the recurring units represented by the following formulas (I), (III) and (IV); and optionally other components.

These aromatic polyester resins have not only a charge transporting function, but also high mechanical strength; in other word, have a combination of electrical properties, optical properties and mechanical properties which are required for the photosensitive layer, particularly for the charge transporting layer in the electrophotographic photoconductor.

Formula (I)

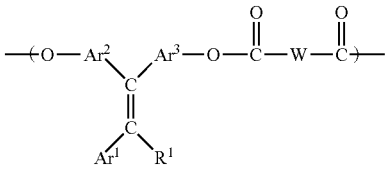

wherein $R^1$ represents any one of a hydrogen atom, an unsubstituted or substituted alkyl group and an unsubstituted or substituted aryl group; $Ar^1$ represents an unsubstituted or substituted aryl group; $Ar^2$ and $Ar^3$ may be the same as or different from each other, and represent individually an unsubstituted or substituted arylene group; and W represents an unsubstituted or substituted divalent aromatic group.

Formula (III)

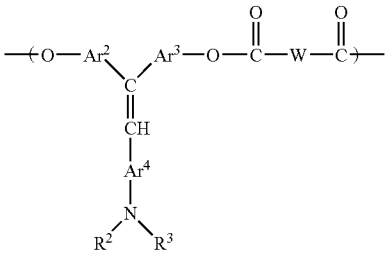

wherein $Ar^2$ and $Ar^3$ may be the same as or different from each other, and represent individually an unsubstituted or substituted arylene group; W represents an unsubstituted or substituted divalent aromatic group; $Ar^4$ represents an unsubstituted or substituted arylene group; $R^2$ and $R^3$ may be the same as or different from each other, and represent individually any one of an acyl group, an unsubstituted or substituted alkyl group and an unsubstituted or substituted aryl group.

Formula (IV)

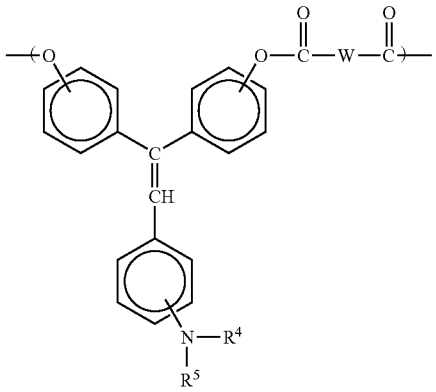

wherein $R^4$ and $R^5$ may be the same as or different from each other, and represent individually any one of an acyl group, an unsubstituted or substituted alkyl group and an unsubstituted or substituted aryl group; and W represents an unsubstituted or substituted divalent aromatic group.

Further, as the aromatic polyester resin according to the invention, any one of an aromatic polyester resin comprising only the recurring unit represented by Formula (I) having a charge transporting function, an aromatic polyester resin comprising only the recurring unit represented by Formula (III) having a charge transporting function, and an aromatic polyester resin comprising only the recurring unit represented by Formula (IV) having a charge transporting function; or an aromatic polyester resin comprising any one of recurring units represented individually by Formula (I), (III) or (IV), and a recurring unit represented by the following Formula (II) for imparting other properties than the charge transporting function to the photosensitive layer; is preferred.

Formula (II)

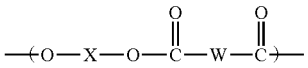

wherein W represents a group represented by the following Formula (V):

Formula (V)

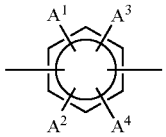

wherein $A^1$, $A^2$, $A^3$ and $A^4$ represent individually any one of a hydrogen atom, an alkyl group, an aryl group, an alkoxy group and a halogen atom; and X represents any one of an aliphatic divalent group, an alicyclic divalent group, an aromatic divalent group, a divalent group formed by bonding these divalent groups and any one of the groups represented by the following formulas:

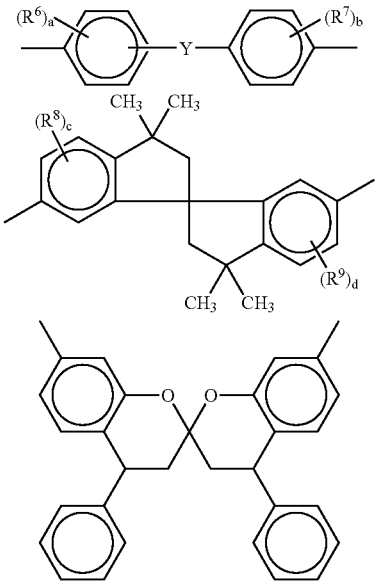

wherein $R^6$, $R^7$, $R^8$ and $R^9$ independently represent any one of an unsubstituted or substituted alkyl group, an unsubstituted or substituted aryl group and a halogen atom; a and b is independently an integer of 0 to 4; c and d is independently an integer of 0 to 3; when a, b, c and d are 2 or more, plural $R^6$s (also $R^7$s, $R^8$s and $R^9$s) may be the same as or different from each other; and Y represents any one of a single bond, a straight alkylene group having a carbon number of 1 to 12, a branched alkylene group having a carbon number of 3 to 12, a cyclic alkylene group, a —O— group, a —S— group, a —SO— group, a —$SO_2$— group, a —CO— group and any one of the groups represented by the following formulas:

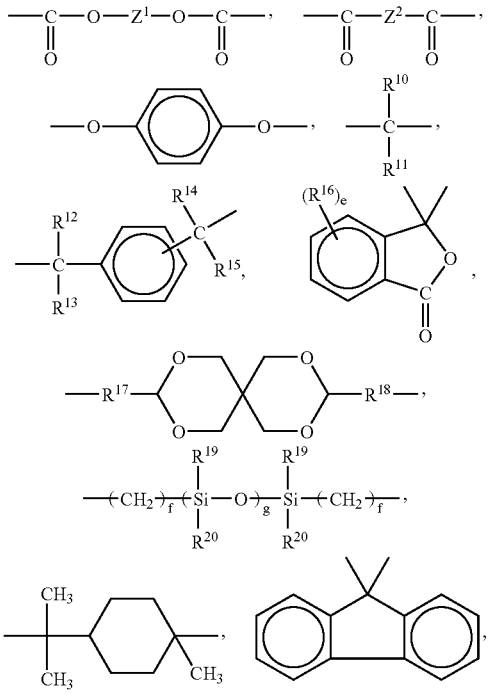

wherein $Z^1$ and $Z^2$ represent individually an unsubstituted or substituted aliphatic divalent group or an unsubstituted or substituted arylene group; $R^6$, $R^7$, $R^8$, $R^9$, $R^{10}$, $R^{11}$ and $R^{12}$ independently represent any one of a hydrogen atom, a halogen atom, an unsubstituted or substituted alkyl group having a carbon number of 1 to 5, an unsubstituted or substituted alkoxy group having a carbon number of 1 to 5, an unsubstituted or substituted aryl group, wherein $R^6$ and $R^7$ may be bonded to each other to form a hydrocarbon ring or heterocyclic ring having a carbon number of 5 to 12 or may form a hydrocarbon ring or heterocyclic ring together with $R^2$ and $R^3$; $R^{13}$ and $R^{14}$ represent individually a single bond or an alkylene group having a carbon number of 1 to 4; $R^{15}$ and $R^{16}$ independently represent an unsubstituted or substituted alkyl group or an unsubstituted or substituted aryl group; e is an integer of 0 to 4; f is an integer of 0 to 20; and g is an integer of 0 to 2,000.

The electrophotographic photoconductor (when it is expressed only as "a photoconductor for the electrophotography" it means both the photoconductor for a dry developing and the photoconductor for a liquid developing) according to the invention is produced by incorporating the above-noted novel aromatic polyester resin as a charge transportable polymer in the photosensitive layer and most outer surface layer, particularly in the charge transporting layer and is excellent in the above-noted various properties required for the photosensitive layer of the electrophotrographic photoconductor.

Further, the electrophotographic photoconductor for a liquid developing according to the invention is a photoconductor for a liquid developing in which the photosensitive layer in a single layer composition comprises the above-noted novel aromatic polyester resin as a charge transporting polymer and which has high resistance to a carrier solvent used for a liquid developing and high sensitivity and which is practical.

With respect to an aromatic polyester resin comprising the recurring unit represented by Formula (I) and the recurring unit represented by Formula (II), a composition ratio k of the recurring unit represented by Formula (I) and a composition ratio j of the recurring unit represented by Formula (II) satisfy preferably the relationship of $0<k/(k+j)\leqq 1$, more preferably the relationship of $0.1<k/(k+j)\leqq 11$. When j and k do not satisfy the above-noted relationship, the charge transporting ability may be remarkably low, and the sensitivity and repeatability may be insufficient.

With respect to an aromatic polyester resin comprising the recurring unit represented by Formula (III) and the recurring unit represented by Formula (II), a composition ratio k' of the recurring unit represented by Formula (III) and a composition ratio j' of the recurring unit represented by Formula (II) satisfy preferably the relationship of $0<k'/(k'+j')\leqq 1$, more preferably the relationship of $0.1<k'/(k'+j')\leqq 1$. When j' and k' do not satisfy the above-noted relationship, the charge transporting ability may be remarkably low, and the sensitivity and repeatability may be insufficient.

With respect to an aromatic polyester resin comprising the recurring unit represented by Formula (IV) and the recurring unit represented by Formula (II), a composition ratio k" of the recurring unit represented by Formula (IV) and a composition ratio j" of the recurring unit represented by Formula (II) satisfy preferably the relationship of $0<k''/(k''+j'')\leqq 1$, more preferably the relationship of $0.1\leqq k''/(k''+j'')\leqq 1$. When j" and k" do not satisfy the above-noted relationship, the charge transporting ability may be remarkably low, and the sensitivity and repeatability may be insufficient.

Hereinbelow, the aromatic polyester resin according to the invention will be described in detail.

First, with respect to the production method of the aromatic polyester resin according to the invention, explanations are given. The aromatic polyester resin according to the invention can be produced according to the same method as a polymerization method of a bisphenol with an aromatic dicarboxylic acid or a derivative thereof which is conventional as a production method of a conventional polyester resin. In other word, the aromatic polyester resin according to the invention can be produced by using at least one of bisphenolic compounds represented by the following formulas (VI), (VII) and (VIII) and according to a method using any one of a transesterification between the bisphenolic compound and an aromatic dicarboxylate ester and a solution or interface polymerization between the bisphenolic compound and a halogenated carbonyl compound, such as an aromatic dicarboxylic acid dichloride. Preferred examples of the halogenated carbonyl compound include halogenated carbonyl compounds produced by substituting carbonyl compounds with a halogen atom other than a chlorine atom, such as carbonyl bromide, carbonyl iodide and carbonyl fluoride.

Formula (VI)

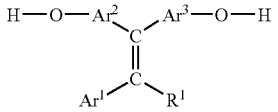

Formula (IX)

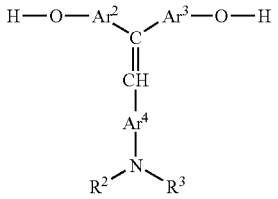

Formula (VIII)

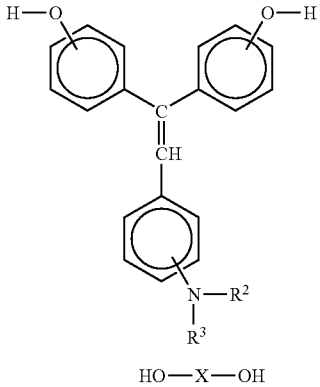

(IX)

wherein $R^1$, $R^2$, $R^3$, $Ar^1$, $Ar^2$, $Ar^3$ and $Ar^4$ represent individually the same as defined above.

As noted above, using a diol represented by Formula (IX) in combination with at least one of diols having a charge transporting function, which are represented by Formulas (VI), (VII) and (VIII), a copolymer in which mechanical properties and the like are improved can be produced. In this case, one type or more types of the diol represented by Formula (IX) may be used. The amount ratio between at least one of the diols having a charge transporting function, which are represented by Formulas (VI), (VII) and (VIII); and a diol represented by Formula (IX), may be selected from a wide range according to a desired property of the photosensitive layer. By selecting a type of the copolymerization, as a copolymer, a random copolymer, an alternating copolymer, a block copolymer, a random alternating copolymer or a random block copolymer can be obtained. For example, by mixing initially at least one of the diols having a charge transporting function, which are represented by Formulas (VI), (VII) and (VIII); and a diol represented by Formula (IX) uniformly, and by subjecting the resultant mixture together with an aromatic dicarboxylic acid or a derivative thereof to a condensation polymerization, a random copolymer comprising at least one of the recurring units represented by Formulas (I), (III) and (IV); and a recurring unit represented by Formula (II) can be obtained.

The production method of the aromatic polyester resin according to the invention can be selected from various conventional polymerization methods. Specific examples of the production method include an interface polymerization, a solution polymerization and a transesterification. Among them, when the aromatic polyester resin according to the invention is produced by the interface polymerization, for example, one or more bifunctional phenolic compound or a bisphenolic compound is reacted with an aromatic dicarboxylic acid dichloride compound in the interface between an alkali aqueous solution and an organic solvent which is substantially insoluble in an alkali aqueous solution and can dissolve an aromatic polyester resin. At this time, by performing the reaction through emulsifying the reaction mixture using a high speed stirring or a catalyst adding, an aromatic polyester resin having a sharp molecular mass distribution can be obtained in a short time. At this time, the reaction can be effected in the presence of a quaternary ammonium salt or quaternary phosphonium salt as a catalyst. From the viewpoint of the productivity of the aromatic polyester resin according to the invention, usually, the polymerization temperature is preferably 0° C. to 40° C. and the polymerization time is preferably 2 hours to 12 hours. After the completion of the polymerization, by separating the aqueous phase and the organic phase and by washing and recovering the polymer dissolved in the organic phase according to a conventional method, a resin which is the object of the invention can be obtained.

In the above-noted interface polymerization, examples of the base used for the alkali aqueous solution include alkali metals and alkaline earth metals. Specific examples thereof include hydroxides, such as sodium hydroxide, potassium hydroxide and calcium hydroxide; carbonate salts, such as sodium carbonate, potassium carbonate, calcium carbonate and sodium bicarbonate. These bases may be used individually or in combination. Among them, sodium hydroxide and potassium hydroxide are preferred. The amount of the base is preferably one time to three times an equivalent of a phenolic hydroxide group contained in the reaction mixture. Preferably, the used water is distilled water or ion-exchanged water.

Examples of the organic solvent include halogenated aliphatic hydrocarbons, such as dichloromethane, 1,2-dichloroethane, 1,2-dichloroethylene, trichloroethane, tetrachloroethane and dichloropropane; halogenated aromatic hydrocarbons, such as chlorobenzene and dichlorobenzene; and mixtures thereof. As the organic solvent, an organic solvent mixture in which any one of the above-noted organic solvent is mixed with any one of organic solvents, such as aromatic hydrocarbons (e.g., toluene, xylene and ethylbenzene) and aliphatic hydrocarbons (e.g., hexane and cyclohexane) may be also used. Among them, halogenated aliphatic hydrocarbons and halogenated aromatic hydrocarbons are preferred and dichloromethane and chlorobenzene are more preferred.

Examples of the quaternary ammonium salt or quaternary phosphonium salt include salts which are used as a catalyst in the reaction for producing the aromatic polyester resin include salts between tertiary amines (e.g., trimethylamine, triethylamine, tri-n-propylamine, tributylamine, tri-n-hexylamine and trioctylamine) and acids (e.g., hydrochloric acid, bromic acid and iodic acid); benzyltriethylammoniumchloride; tetramethylammoniumchloride; tetraethylammoniumbromide; tetrabutylammoniumchloride; tetrabutylammoniumbromide; trioctylmethylammoniumchloride; phenyltriethylammoniumchloride; tetrabutylphosphoniumbromide; triethyloctadecylphosphoniumbromide; N-laurylpyridiniumchloride; and laurylpicoliumchloride. These catalysts may be used individually or in combination.

Further, for preventing the oxidation of the diol in the alkali aqueous solution, an anti-oxidant, such as hydrosulfite may be added in the reaction mixture.

On the other hand, when the aromatic polyester resin according to the invention is produced by the solution polymerization, a diol dissolved in a solvent to which a deoxidizer is added and an aromatic carboxylic acid chloride compound are subjected to a solution polymerization, thereby obtaining the aromatic polyester resin. Examples of the deoxidizer include tertiary amines, such as trimethylamine, triethylamine and tripropylamine; and pyridine. Preferred examples of the solvent used for the solution polymerization include halogenated hydrocarbons, such as dichloromethane, dichloroethane, trichloroethane, tetrachloroethane, trichloroethylene and chloroform; cyclic ether solvents, such as tetrahydrofuran and dioxane; and pyridine. Usually, the polymerization temperature is preferably 0° C. to 80° C. and the polymerization time is preferably 2 hours to 12 hours.

The aromatic polyester resin can be produced by a transesterification. In this case, in the presence of an inert gas, a diol and an aromatic dicarboxylic acid dialkyl ester compound are mixed and the resultant mixture is subjected to the transesterificatoion usually at 80° C. to 350° C. under reduced pressure. The reduced degree of the pressure is gradually changed and at the end of the reaction, the pressure is rendered 1 mmHg or lower, thereby distilling off a generated alcohol out of the reaction system. Usually, the polymerization time is preferably 1 hour to 6 hours and optionally in the reaction mixture, an anti-oxidant may be added. Preferred examples of the alkyl group which the aromatic dicarboxylic acid dialkylester compound has include lower alkyl groups, such as a methyl group, an ethyl group, a propyl group and a butyl group.

In all of the above-noted three polymerization methods, it is desired that for controlling the molecular mass of the polymer which is to be produced, a terminator is used as a molecular-mass controlling agent. Accordingly, to the terminal of the aromatic polyester resin used in the invention, a substituent derived from the terminator may be bonded. Examples of the terminator include monovalent aromatic hydroxy compounds, monovalent carboxylic acids and halide derivatives of the monovalent carboxylic acids. Specific examples of the monovalent aromatic hydroxyl compound include phenols, such as phenol, o,m,p-cresol, o,m,p-ethylphenol, o,m,p-propylphenol, o,m,p-isopropylphenol, o,m,p-tert-butylphenol, p-cumylphenol, p-cyclohexylphenol, p-octylphenol, p-nonylphenol, 2,4-xylenol, 2,4,6-trimethylphenol, 2,3,6-trimethylphenol, p-methoxyphenol, p-hexyloxyphenol, p-decyloxyphenol, o-chlorophenol, m-chlorophenol, p-chlorophenol, p-bromophenol, pentabromophenol, pentachlorophenol, p-phenylphenol, p-isopropenylphenol, 2,4-bis(1-methyl-1-phenylethyl) phenol, β-naphthol, α-naphthol, p-(2,4,4-trimethylcromanyl) phenol, 2-(4-methoxyphenyl)-2-(4-hydroxyphenyl) propane; and alkali metal salts or alkaline earth metal salts thereof.

Specific examples of the monovalent carboxylic acid include aliphatic acids and alkali metal salts or alkaline earth metal salts thereof, such as acetic acid, propionic acid, butylic acid, valerianic acid, caproic acid, heptoic acid, caprylic acid, 2,2-dimethylpropionic acid, 3-methylbutylic acid, 3,3-dimethylbutylic acid, 4-methylvalerianic acid, 3,3-dimethylvalerianic acid, 4-methylcaproic acid, 3,5-dimethylcaproic acid and phenoxyacetic acid; and benzoic acids and alkali metal salts or alkaline earth metal salts thereof, such as benzoic acid, p-methylbenzoic acid, p-tert-butylbenzoic acid, p-butoxybenzoic acid, p-octyloxybenzoic acid, p-phenylbenzoic acid, p-benzylbenzoic acid and p-chlorobenzoic acid. Examples of a halide derivative of a monovalent carboxylic acid include halide derivatives of the above-noted monovalent carboxylic acids.

These terminators may be used individually or in combination. The terminator is preferably a monovalent aromatic hydroxyl compound, more preferably any one of phenol, o,m,p-cresol, 2,4-xylenol, 2,4,6-trimethylphenol, 2,3,6-trimethylphenol, p-tert-butylphenol and p-cumylphenol.

For improving the mechanical properties of the photoconductor, during the polymerization, a small amount of a branching agent may be added in the polymerization mixture. Examples of the branching agent include compounds having three or more reactive groups (which may be the same as or different from each other) selected from the group consisting of aromatic hydroxyl groups, aromatic carboxylic acid groups and derivatives thereof.

Specific examples of the branching agent include fluoroglycinol, 4,6-dimethyl-2,4,6-tris(4-hydroxyphenyl)-2-heptene, 4,6-dimethyl-2,4,6-tris(4-hydroxyphenyl) heptane, 1,3,5-tris(4-hydroxyphenyl) benzene, 1,1,1,-tris(4-hydroxyphenyl) ethane, 1,1,2-tris(4-hydroxyphenyl) propane, α,α,α'-tris(4-hydroxyphenyl)-1-ethyl-4-isopropyl benzene, 2,4-bis[α-methyl-α-(4-hydroxyphenyl) ethyl] phenol, 2-(4-hydroxyphenyl)-2-(2,4-dihydroxyphenyl) propane, tris(4-hydroxyphenyl) phosphine, 1,1,4,4-tetrakis(4-hydroxyphenyl) cyclohexane, 2,2-bis[4,4-bis(4-hydroxyphenylcyclohexyl)] propane, α,α,α',α'-tetrakis(4-hydroxyphenyl)-1,4-diethylbenzene, 2,2,5,5-tetrakis(4-hydroxyphenyl) hexane, 1,1,2,3-tetrakis(4-hydroxyphenyl) propane, 1,4-bis(4,4-dihydroxytriphenylmethyl) benzene, 3,3', 5,5'-tetrahydroxy diphenyl ether, trimesic acid trichloride and cyanuric acid chloride. These branching agents may be used individually or in combination.

The thus obtained aromatic polyester resin contains impurities, such as a catalyst and an anti-oxidant which are used for the polymerization; an unreacted diol and terminator; and an inorganic salt generated during the polymerization, which are removed for purifying the obtained aromatic polyester resin before the use of the obtained aromatic polyester resin. This purification operation may be performed according to a conventional method. For example, the obtained polymerization mixture is washed using a washing solution, such as an alkali (e.g., sodium hydroxide and potassium hydroxide) aqueous solution; an acid (e.g., hydrochloric acid, nitric acid and phosphoric acid) aqueous solution; and water, and from the resultant polymerization mixture, the aromatic polyester resin is separated by a stand-still separation or a centrifugal separation.

Examples of other purification methods include a method in which the aromatic polyester resin is separated out by introducing the polymerization mixture into a solvent in which the aromatic polyester resin is insoluble, a method in which the solvent in the polymerization mixture is distilled off by dispersing the polymerization mixture in a warm water, and a method in which the aromatic polyester resin is separated by passing the polymerization mixture through an adsorption resin column. The obtained aromatic polyester resin is dried usually at a temperature which is a decomposition temperature of the aromatic polyester resin or lower, preferably at 20° C. to a melt temperature of the aromatic polyester resin under reduced pressure. The drying of the aromatic polyester resin is performed until the concentration of an impurity, such as a residual solvent is lowered to a predetermined amount or less. More specifically, the drying is performed until the concentration of the residual solvent is lowered to usually 1,000 ppm or less, preferably 300 ppm or less, more preferably 100 ppm or less.

Into the aromatic polyester resin produced by the above-noted method, optionally an additive, such as an anti-oxidant, light stabilizer, heat stabilizer, lubricant and plasticizer may be added.

Next, with respect to the recurring unit (the synthesis of a raw material diol represented by formula (IV) for producing the aromatic polyester resin is below described and the detail thereof is the same synthesis method as described in JP-A No. 9-272735) represented by Formula (I) which is a main recurring unit in the aromatic polyester resin according to the invention, explanations are given in more detail. In the invention, "aryl" group means groups including a heterocyclic group.

In the above-noted Formula (I), $R^1$ represents any one of a hydrogen atom, an unsubstituted or substituted alkyl group and an unsubstituted or substituted aryl group. Examples of $R^1$ as an unsubstituted or substituted alkyl group include straight or branched alkyl groups having a carbon number of 1 to 6 which may have a substituent, such as a fluorine atom, a cyano group, a phenyl group and a phenyl group substituted by a halogen atom or a straight or branched alkyl group having a carbon number of 1 to 6. Specific examples of $R^1$ include a methyl group, an ethyl group, a n-propyl group, an isopropyl group, a t-butyl group, a sec-butyl group, a n-butyl group, an isobutyl group, a n-hexyl group, a cyclohexyl group, a trifluoromethyl group, a 2-cyanoethyl group, a benzyl group, a 4-chlorobenzyl group and 4-methylbenzyl group.

Examples of $R^1$ as an unsubstituted or substituted aryl group include a phenyl group, a naphthyl group, a bisphenylyl group, a terphenylyl group, a pyrenyl group, a fluorenyl group, a 9,9-dimethyl-2-fluorenyl group, an azurenyl group, an anthoryl group, a triphenylenyl group, a chrysenyl group, a fluorenilidenephenyl group, a 5H-dibenzo [a,d] cycloheptenilidenephenyl group, a thienyl group, a benzothienyl group, a furyl group, a benzofuranyl group, a carbazolyl group, a pyridinyl group, a pyrrolidyl group and an oxazolyl group. These unsubstituted or substituted aryl groups may have a substituent, such as the above-noted unsubstituted or substituted alkyl group; an alkoxy group having the above-noted unsubstituted or substituted alkyl group; a halogen atom, such as a fluorine atom, chlorine atom, bromine atom and iodine atom; and an amino group represented by the following formula:

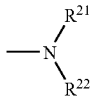

wherein $R^{21}$ and $R^{22}$ represent individually any one of an unsubstituted or substituted alkyl group defined above as $R^1$ and an unsubstituted or substituted aryl group defined as $R^1$; and $R^{21}$ and $R^{22}$ may cooperatively form a ring or a carbon atom in $R^{21}$ (as an aryl group) and a carbon atom in $R^{22}$ (as an aryl group) may cooperatively form a ring. Specific examples thereof include a piperidino group, a morphorino group and a julolidyl group.

In the above-noted Formula (I), $Ar^1$ represents an unsubstituted or substituted aryl group. Examples of $Ar^1$ as an unsubstituted or substituted aryl group include groups represented by the following Formula (X); and monovalent groups derived from heterocyclic groups having an amine structure, such as a pyrrol group, a pyrrazol group, an imidazol group, a triazol group, a dioxazol group, an indol group, an isoindol group, a benzimidazol group, a benzotriazol group, a benzisoxazine group, a carbazol group and a phenoxazine group. These monovalent groups may have a substituent, such as the unsubstituted or substituted alkyl group, the unsubstituted or substituted aryl group, a fluorine atom, a chlorine atom, a bromine atom and a iodine atom, which are defined as $Ar^1$ above.

Formula (X)

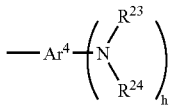

wherein $R^{23}$ and $R^{24}$ represent individually any one of an acyl group, an unsubstituted or substituted alkyl group and an unsubstituted or substituted aryl group; $Ar^4$ represents an unsubstituted or substituted arylene group; and h is an integer of 1 to 3.

In the above-noted Formula (X), examples of $R^{23}$ and $R^{24}$ as an acyl group include an acetyl group, a propionyl group and a benzoyl group. Examples of $R^{23}$ and $R^{24}$ as an unsubstituted or substituted alkyl group include an unsubstituted or substituted alkyl group defined as $R^1$ above. Examples $R^{23}$ and $R^{24}$ as an unsubstituted or substituted aryl group include an unsubstituted or substituted aryl group defined as $R^1$ above and a group represented by the following Formula (XI):

Formula (XI)

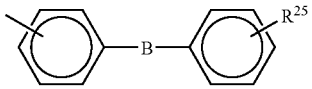

wherein B represents any one of a —O— group, a —S— group, a —SO— group, a —$SO_2$— group, a —CO— group and a group selected from the following divalent groups; and $R^{25}$ represents any one of a hydrogen atom, an unsubstituted or substituted alkyl group defined as $R^1$, an alkoxy group, a halogen atom, an unsubstituted or substituted arly group defined as $R^1$, an amino group, a nitro group and a cyano group.

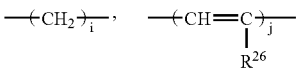

wherein $R^{26}$ represents any one of a hydrogen atom, an unsubstituted or substituted alkyl group defined as $R^1$, an unsubstituted or substituted aryl group defined as $R^1$; and "i" is an integer of 1 to 12 and "j" is an integer of 1 to 3.

Specific examples of $R^{25}$ as an alkoxy group include a methoxy group, an ethoxy group, a n-propoxy group, an isopropoxy group, a n-butoxy group, an isobutoxy group, a sec-butoxy group, a t-butoxy group, a 2-hydroxyethoxy group, a 2-cyanoethoxy group, a benzyloxy group, a 4-methylbenzyloxy group and a trifluoromethoxy group. Examples of $R^{25}$ as a halogen atom include a fluorine atom, a chlorine atom, a bromine atom and an iodine atom. Examples of $R^{25}$ as an amino group include an amino group defined as a substituent of the unsubstituted or substituted aryl group defined as $R^1$. In the above-noted Formula (X), examples of $Ar^4$ as an arylene group include a divalent group derived from the unsubstituted or substituted aryl group defined as $R^1$.

In the above-noted Formula (III), $Ar^2$ and $Ar^3$ represent individually an unsubstituted or substituted arylene group. Examples of $Ar^2$ and $Ar^3$ as the arylene group include a divalent group derived from the unsubstituted or substituted aryl group defined as $R^1$. As noted above, with respect to the recurring unit represented by Formula (III), explanations have been given; however, the same symbol represents the same group also in other formulas.

Hereinbelow, with respect to the diols represented by the above-noted Formulas (VI), (VII) and (VIII), which is a material monomer for producing the novel aromatic polyester resin according to the invention, explanations are given.

Among these diols, for example, a diol represented by Formula (VI) can be produced as shown in the following reaction formula according to a method comprising obtaining a stilbene compound represented by the following Formula (XIV) by subjecting a phosphonate ester represented by the following Formula (XII) and a carbonyl compound represented by the following Formula (XIII) to the following reaction; and opening an ether group or ester group of the above-obtained stilbene compound.

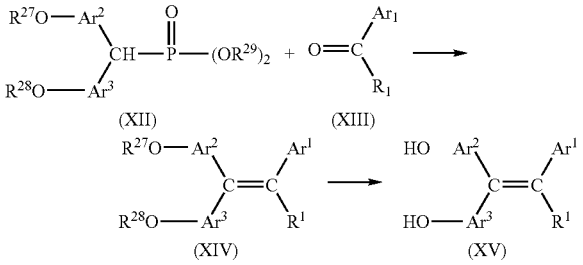

wherein $R^{27}$ and $R^{28}$ represent individually any one of an unsubstituted or substituted alkyl group defined as $R^1$ and an acyl group defined as $R^{23}$ and $R^{24}$; $R^{29}$ represents a lower alkyl group and specific examples thereof include a straight or branched alkyl group having a carbon number of 1 to 5, such as a methyl group, an ethyl group, a n-propyl group, an isopropyl group, a t-butyl group, a sec-butyl group, a n-butyl group, an isobutyl group and a n-pentyl group; and $R^1$, $Ar^1$, $Ar^2$ and $Ar^3$ represent individually the same $R^1$, $Ar^1$, $Ar^2$ and $Ar^3$ as defined above.

Further, the diols represented by Formulas (VII) and (VIII) can be produced by subjecting a corresponding phosphonate ester and a corresponding carbonyl compound to a reaction of the same method as that for producing the above-noted diol represented by Formula (VI).

Example of the aromatic polyester resin according to the invention include an aromatic polyester resin comprising only a recurring unit represented by Formula (I) which has a charge transporting function; and a copolymer comprising a recurring unit represented by Formula (I) and another recurring unit which is used for controlling the mechanical properties of the obtained copolymer. Examples of the above-noted another recurring unit include recurring units of conventional polyester resins. Among them, a recurring unit represented by Formula (II) is preferred. Hereinbelow, with respect to another main recurring unit represented by Formula (II), explanations are given in detail referring to examples of a recurring unit represented by Formula (IX) which is a material for producing a copolymer comprising the recurring unit represented by Formula (II).

Specific examples of a dioxy compound represented by the above-noted Formula (IX) in which X represents any one of a divalent aliphatic group and a divalent alicyclic group include ethylene glycol, diethylene glycol, triethylene glycol, polyethylene glycol, polytetramethylene ether glycol, 1,3-propanediol, 1,4-butanediol, 1,5-pentanediol, 3-methyl-1,5-pentanediol, 1,6-hexanediol, 1,5-hexanediol, 1,7-heptanediol, 1,8-octanediol, 1,9-nonanediol, 1,10-decanediol, 1,11-undecanediol, 1,12-dodecanediol, neopentyl glycol, 2-ethyl-1,6-hexanediol, 2-methyl-1,3-propanediol, 2-ethyl-1,3-propanediol, 2,2-dimethyl-1,3-propanediol, 1,3-cyclohexanediol, 1,4-cyclohexanediol, cyclohexane-1,4-dimethanol, 2,2-bis(4-hydroxycyclohexyl) propane, xylenediol, 1,4-bis(2-hydroxyethyl) benzene, 1,4-bis(3-hydroxypropyl) benzene, 1,4-bis(4-hydroxybutyl) benzene, 1,4-bis(5-hydroxypentyl) benzene and 1,4-bis(6-hydroxyhexyl) benzene.

Examples of a dioxy compound represented by Formula (IX) in which X represents a divalent aromatic group include a divalent group derived from the unsubstituted or substituted aryl group defined as $R^1$. X represents also a divalent group produced by binding the above-noted divalent groups to each other, and any one of divalent groups represented by the following formulas.

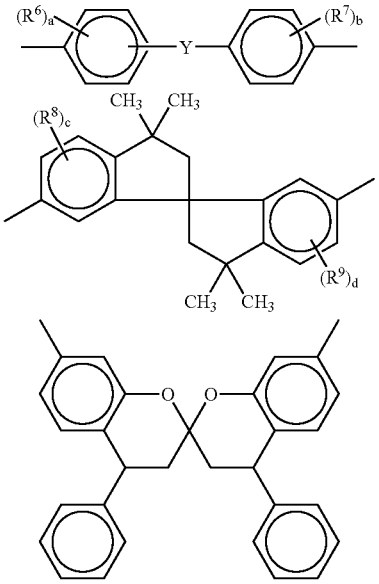

wherein $R^6$, $R^7$, $R^8$ and $R^9$ independently represents any one of an unsubstituted or substituted alkyl group, an unsubstituted or substituted aryl group and a halogen atom; a and b are independently an integer of 0 to 4; c and d are independently an integer of 0 to 3; when a, b, c and d are 2 or more, plural $R^6$s (also $R^7$s, $R^8$s and $R^9$s) may be the same as or different from each other; and Y represents any one of a single bond, a straight alkylene group having a carbon number of 1 to 12, a branched alkylene group having a carbon number of 3 to 12, a cyclic alkylene group, a —O— group, a —S— group, a —SO— group, a —$SO_2$— group, a —CO— group and any one of the groups represented by the following formulas:

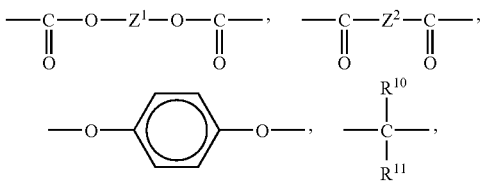

-continued

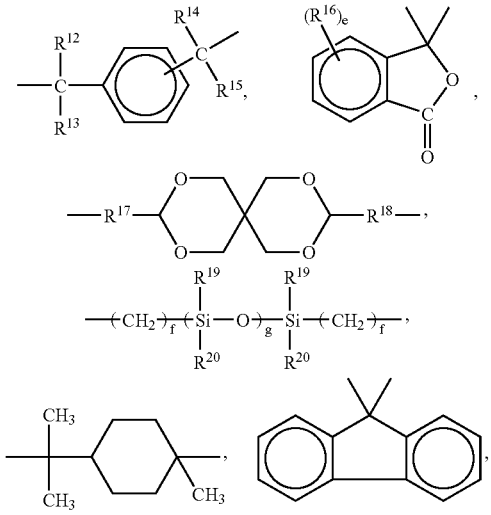

wherein $Z^1$ and $Z^2$ represent individually any one of an unsubstituted or substituted divalent aliphatic group and an unsubstituted or substituted arylene group; $R^6$, $R^7$, $R^8$, $R^9$, $R^{10}$, $R^{11}$ and $R^{12}$ independently represent any one of a hydrogen atom, a halogen atom, an unsubstituted or substituted alkyl group having a carbon number of 1 to 5, an unsubstituted or substituted alkoxy group having a carbon number of 1 to 5, and an unsubstituted or substituted aryl group, wherein $R^6$ and $R^7$ may be bonded to each other to form a hydrocarbon ring or heterocyclic ring having a carbon number of 5 to 12 or may form a hydrocarbon ring or a heterocyclic ring together with $R^2$ and $R^3$; $R^{13}$ and $R^{14}$ represent individually any one of a single bond and an alkylene group having a carbon number of 1 to 4; $R^{15}$ and $R^{16}$ independently represent any one of an unsubstituted or substituted alkyl group and an unsubstituted or substituted aryl group; e is an integer of 0 to 4; f is an integer of 0 to 20; and g is an integer of 0 to 2,000.

In the above-noted formulas, the unsubstituted or substituted alkyl group and the unsubstituted or substituted aryl group represent individually the same alkyl group and the same aryl group as those defined as $R^1$ above. The halogen atom represents any one of a fluorine atom, a chlorine atom, a bromine atom and an iodine atom. Examples of the unsubstituted or substituted divalent aliphatic group as $Z^1$ and $Z^2$ include a divalent group produced by eliminating a hydroxy group from a diol in which X is a divalent aliphatic group or a divalent alicyclic group. Examples of the unsubstituted or substituted arylene group as $Z^1$ and $Z^2$ include a divalent group derived from an unsubstituted or substituted aryl group defined as $R^1$ above.

Preferred specific examples of the diol in which X represents a divalent aromatic group include bis(4-hydroxyphenyl) methane, bis(2-methyl-4-hydroxyphenyl) methane, bis(3-methyl-4-hydroxyphenyl) methane, 1,1-bis(4-hydroxyphenyl) ethane, 1,2-bis(4-hydroxyphenyl) ethane, bis(4-hydroxyphenyl) phenylmethane, bis(4-hydroxyphenyl) diphenylmethane, 1,1-bis(4-hydroxyphenyl)-1-phenylethane, 1,3-bis(4-hydroxyphenyl)-1,1-dimethylpropane, 2,2-bis(4-hydroxyphenyl) propane, 2-(4-hydroxyphenyl)-2-(3-hydroxyphenyl) propane, 1,1-bis(4-hydroxyphenyl)-2-methylpropane, 2,2-bis(4-hydroxyphenyl) butane, 1,1-bis(4-hydroxyphenyl)-3-methylbutane, 2,2-bis(4-hydroxyphenyl)

hexane, 2,2-bis(4-hydroxyphenyl)-4-methylhexane, 2,2-bis (4-hydroxyphenyl) hexane, 4,4-bis(4-hydroxyphenyl) heptane, 2,2-bis(4-hydroxyphenyl) nonane, bis(3,5-dimethyl-4-hydroxyphenyl) methane, 2,2-bis(3-methyl-4-hydroxyphenyl) propane, 2,2-bis(3-isopropyl-4-hydroxyphenyl) propane, 2,2-bis(3-sec-butyl-4-hydroxyphenyl) propane, 2,2-bis(3-tert-butyl-4-hydroxyphenyl) propane, 2,2-bis(3-cyclohexyl-4-hydroxyphenyl) propane, 2,2-bis(3-allyl-4-hydroxyphenyl) propane, 2,2-bis(3-phenyl-4-hydroxyphenyl) propane, 2,2-bis(3,5-dimethyl-4-hydroxyphenyl) propane, 2,2-bis(3-chloro-4-hydroxyphenyl) propane, 2,2-bis(3,5-dichloro-4-hydroxyphenyl) propane, 2,2-bis(3-bromo-4-hydroxyphenyl) propane, 2,2-bis(3,5-dibromo-4-hydroxyphenyl) propane, 2,2-bis(4-hydroxyphenyl) hexafluoropropane, 1,1-bis(4-hydroxyphenyl) cyclopentane, 1,1-bis(4-hydroxyphenyl) cyclohexane, 1,1-bis(3-methyl-4-hydroxyphenyl) cyclohexane, 1,1-bis(3,5-dimethyl-4-hydroxyphenyl) cyclohexane, 1,1-bis(3,5-dichloro-4-hydroxyphenyl) cyclopentane, 1,1-bis(4-hydroxyphenyl)-3,3,5-trimethylcyclopentane, 1,1-bis(4-hydroxyphenyl) cycloheptane, 2,2-bis(4-hydroxyphenyl) norbornane, 2,2-bis (4-hydroxyphenyl) adamantane, 4,4'-dihydroxyphenyl ether, 4,4'-dihydroxy-3,3'-dimethyl diphenyl ether, ethylene glycol bis(4-hydroxyphenyl) ether, 4,4'-dihydroxy diphenyl sulfide, 3,3'-dimethyl-4,4'-dihydroxy diphenyl sulfide, 3,3'5,5'-tetramethyl-4,4'-dihydroxy diphenyl sulfide, 4,4'-dihydroxy diphenyl sulfoxide, 3,3'-dimethyl-4,4'-dihydroxy diphenyl sulfoxide, 4,4'-dihydroxy diphenyl sulfone, 3,3'-dimethyl-4,4'-dihydroxy diphenyl sulfone, 3,3'-diphenyl-4,4'-dihydroxy diphenyl sulfone, 3,3'-dichloro-4,4'-dihydroxy diphenyl sulfone, bis(4-hydroxyphenyl) ketone, bis(3-methyl-4-hydroxyphenyl) ketone, 3,3,3',3'-tetramethyl-6,6'-dihydroxy spiro (bis) indane, 3,3',4,4'-tetrahydro-4,4,4',4'-tetramethyl-2,2'-spirobi(2H-1-benzopyran)-7,7'-diol, trans-2,3-bis(4-hydroxyphenyl)-2-butane, 9,9-bis(4-hydroxyphenyl) fluorene, 9,9-bis(4-hydroxyphenyl) xanthene, 1,6-bis(4-hydroxyphenyl)-1,6-hexanedione, α,α,α',α'-tetramethyl-α,α'-bis(4-hydroxyphenyl)-p-xylene, α,α,α',α'-tetramethyl-α,α'-bis(4-hydroxyphenyl)-m-xylene, 2,6-dihydroxy benzo-p-dioxine, 2,6-dihydroxy thianthrene, 2,7-dihydroxy phenoxathine, 9,10-dimethyl-2,7-dihydroxy phenazine, 3,6-dihydroxy benzofuran, 3,6-dihydroxy benzothiophene, 4,4'-dihydroxy biphenyl, 1,4-dihydroxy naphthalene, 2,7-dihydroxy pyrene, hydroquinone, resorcin, ethylene glycol-bis(4-hydroxybenzoate), diethylene glycol-bis(4-hydroxybenzoate), triethylene glycol-bis(4-hydroxybenzoate), 1,3-bis(4-hydroxyphenyl)-tetramethyl disiloxane, and a phenol-modified silicone oil.

Besides the above-noted diols, an aromatic diol compound containing an ester bond which is produced by subjecting 2 mols of a diol and 1 mol of isophthaloyl chloride or terephthaloyl chloride to a reaction is also preferred. Heretofore, with respect to the recurring unit represented by Formula (II), explanations have been given referring to examples of the recurring unit represented by Formula (IX) which is a material for producing the recurring unit represented by Formula (II). Among these diols, a diol in which X represents a divalent aromatic group is most preferred. The same symbols in Formulas (II) and (IX) represent the same groups also in the other formulas.

Next, with respect to the group "W" in recurring units represented by Formulas (I), (II), (III) and (IV), each of which is another main recurring unit according to the invention, explanations are given.

W represents an unsubstituted or substituted divalent aromatic group. Examples of the divalent aromatic group include divalent aromatic groups by which properties of the aromatic polyester resin according to the invention are not impaired when the aromatic polyester resin according to the invention is produced by comprising any one of recurring units represented by Formulas (I) to (IV) in which W represents any one of the above-noted divalent aromatic groups. Specific examples thereof include a phenylene group, a naphthylene group and a biphenylene group. Examples of a substituent by which W is substituted include a hydrogen atom, straight, branched or cyclic alkyl groups having a carbon number of 1 to 6, aryl groups, halogen atoms and straight, branched or cyclic alkoxy groups having a carbon number of 1 to 6. Specific examples thereof include alkyl groups, such as a methyl group, an ethyl group, a n-propyl group, an isopropyl group, a t-butyl group, a sec-butyl group, a n-butyl group, an isobutyl group, a hexyl group and a cyclohexyl group; aryl groups, such as a phenyl group, a naphthyl group and a biphenylyl group; alkoxy groups having the above-noted alkyl group; and halogen atoms, such as a fluorine atom, a chlorine atom, a bromine atom and an iodine atom. Among the above-exemplified divalent aromatic groups as W, a phenylene group is preferred. In other word, as W preferred are divalent phenylene groups represented by the following Formula (V):

Formula (V)

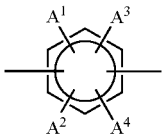

wherein $A^1$, $A^2$, $A^3$ and $A^4$ represent individually any one of a hydrogen atom, an alkyl group, an aryl group, an alkoxy group and a halogen atom. $A^1$, $A^2$, $A^3$ and $A^4$ represent individually the same substituent as the above-exemplified substituent by which W is substituted. Among them, it is most preferred that all of $A^1$, $A^2$, $A^3$ and $A^4$ are a hydrogen atom.

In a polyester copolymer produced by copolymerizing a monomer of the recurring unit represented by Formula (I) and a monomer of the recurring unit represented by Formula (II), the amount ratio of the monomer of the recurring unit represented by Formula (I) is not restricted. However, since the amount ratio of the monomer of the recurring unit represented by Formula (I) corresponds to the charge transporting ability of the aromatic polyester resin which is to be produced, and is preferably 5 mol % or more, more preferably 20 mol % or more, based on the mol of all monomers of all recurring units which are used for producing the aromatic polyester resin according to the present invention.

The aromatic polyester resin according to the invention has a number average molecular mass (converted as a polystyrene) preferably of 1,000 to 500,000, more preferably 10,000 to 200,000 and has a mass average molecular mass (converted as a polystyrene and measured by gel permeation chromatography) of preferably 7,000 to 1,000,000, more preferably 10,000 to 300,000. When the molecular mass of the aromatic polyester resin is too small, a disadvantage is caused wherein the film formation properties of the photosensitive layer (or the most outer surface layer) are impaired (e.g., a crack is caused.) and the resistance of the photoconductor to a carrier liquid becomes unsatisfactorily, thus the practicability of the photoconductor becomes poor. On the other hand, when the molecular mass is too large, the solubility of the aromatic polyester resin in a general organic solvent becomes poor and the viscosity of the coating liquid for disposing the photosensitive layer becomes high, thus the coating becomes difficult and the practicability of the photoconductor becomes also poor.

The aromatic polyester resin according to the invention exhibits an advantage solubility in various general organic solvents, such as dichloromethane, tetrahydrofuran, chloroform, toluene, monochlorobenzene and xylene. Therefore, by preparing a coating liquid in which the polyester resin according to the invention is dissolved in a proper solvent which can dissolve the polyester resin in a proper concentration and by using the coating liquid, various photoconductors can be produced according to a conventional coating method.

The amount of the charge transporting polymer according to the invention in the photosensitive layer comprising the aromatic polyester resin according to the invention is preferably 20% by mass to 100% by mass, more preferably 30% by mass to 100% by mass, based on the total mass of the whole photosensitive layer.

Further, the photosensitive layer of the elctrophotographic photoconductor for a liquid developing according to the invention comprises as an essential component an acceptor compound. Also the photosensitive layer of the electrophotographic photoconductor for a dry developing according to the invention comprises preferably an acceptor compound. With respect to a 2,3-diphenylindene compound represented by the following Formula (F1) which is a preferred example of an acceptor compound which is a main composition of the aromatic polyester resin according to the invention, further explanations are given.

Formula (F1)

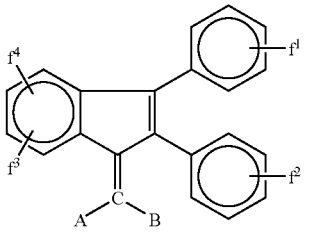

wherein $f^1$, $f^2$, $f^3$ and $f^4$ represent individually any one of a hydrogen atom, a halogen atom, an unsubstituted or substituted alkyl group, a cyano group and a nitro group; A and B represent individually any one of a hydrogen atom, an unsubstituted or substituted aryl group, a cyano group, an alkoxycarbonyl group and an aryloxycarbonyl group.

In a 2,3-diphenylindene compound represented by Formula (F1), $f^1$ to $f^4$ represent individually any one of a hydrogen atom; a halogen atom, such as a fluorine atom and a chlorine atom; an alkyl group, such as a methyl group, an ethyl group, a propyl group, an isopropyl group, a n-butyl group and a t-butyl group; a benzyl group; a substituted alkyl group, such as a methoxymethyl group and a methoxyethyl group; a cyano group; and a nitro group. A and B represent individually any one of a hydrogen atom; a halogen atom, such as a fluorine atom and a chlorine atom; an alkyl group, such as a methyl group, an ethyl group, a n-propyl group, a an isopropyl group, a n-butyl group, and a t-butyl group; a benzyl group; a substituted alkyl group, such as a methoxymethyl group and a methoxyethyl group; a cyano group; an alkoxycarbonyl group, such as a methoxycarbonyl group and an ethoxycarbonyl group; a benzyloxycarbonyl group; a substituted alkylcarbonyl group, such as and a methoxyethylcarbonyl group; and an aryl group, such as a phenyl group and a naphthyl group. Examples of the substituent which A and B may have include an alkyl group, such as a methyl group and an ethyl group; a phenyl group; a methoxy group; an ethoxy group; a phenoxy group; and a halogen atom, such as a fluorine atom and a chlorine atom. Particularly, as a 2,3-diphenylindene compound represented by Formula (F1), (2,3-diphenyl-1-indene) malonnitrile represented by the following Formula (A-1) is preferably used.

Formula (A-1)

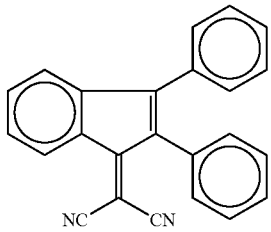

The above-noted acceptor compound is not restricted and may be properly selected also from conventional compounds. Specific examples thereof include chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-indeno4H-indeno[1,2-b]thiophene-4-on and 1,3,7-trinitrodibenzothiophene-5,5-dioxide. Further, as the above-noted acceptor compound, acceptor compounds represented by the following Formulas (A-2), (A-3) and (A-4) can be preferably used.

Formula (A-2)

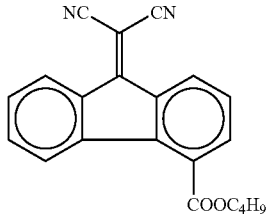

Formula (A-3)

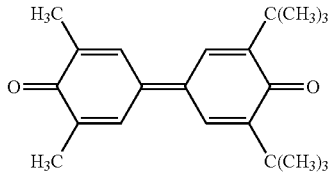

Formula (A-4)

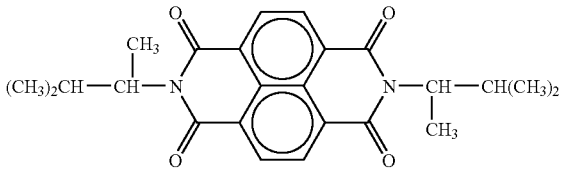

These organic acceptor compounds may be used individually or in combination. The amount of the organic acceptor compound in the photosensitive layer is preferably 1% by mass to 40% by mass, more preferably 5% by mass to 40% by mass, based on the total mass of the photosensitive layer.

Further, the photosensitive layer of the electrophotographic photoconductor for a liquid developing according to the invention comprises optionally a phenolic compound. With respect to a phenolic compound represented by the following Formula (G-1) which is a main composition of the aromatic polyester resin according to the invention, explanations are given.

Formula (G-1)

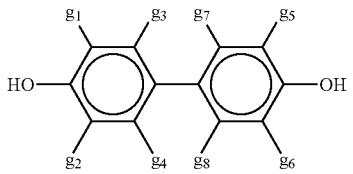

wherein $g_1$ to $g_8$ represent individually any one of a hydrogen atom; an unsubstituted or substituted alkyl group; an unsubstituted or substituted alkoxycarbonyl group; an unsubstituted or substituted aryl group; and an unsubstituted or substituted alkoxy group.

In the phenolic compound represented by Formula (G-1) according to the invention, $g_1$ to $g_8$ represent individually any one of a hydrogen atom; an alkyl group, such as a methyl group, an ethyl group, a propyl group, an isopropyl group, a butyl group and a t-butyl group; a benzyl group; a substituted alkyl group, such as a methoxymethyl group and a methoxyethyl group; an alkoxycarbonyl group, such as a methoxycarbonyl group and an ethoxycarbonyl group; a substituted alkoxycarbonyl group, such as a benzyloxycarbonyl group and a methoxyethylcarbonyl group; and an aryl group, such as a phenyl group and naphthyl group. Examples of the substituent which $g_1$ to $g_8$ may have include an alkyl group, such as a methyl group and an ethyl group; a phenyl group; a methoxy group; an ethoxy group; a phenoxy group; and a halogen atom, such as a fluorine atom and a chlorine atom. Examples of $g_1$ to $g_8$ as the above-noted unsubstituted or substituted alkoxy group include an alkoxy group having the above-noted unsubstituted or substituted alkyl group.

The amount of the phenolic compound in the photosensitive layer is preferably 0.1% by mass to 50% by mass, more preferably 0.1% by mass to 30% by mass, based on the total mass of the photosensitive layer. When the amount is less than 0.1% by mass, the effect of the phenolic compound for improving the durability of the photoconductor in the repeated using becomes unsatisfactory. On the other hand, when the amount is more than 50% by mass, the lowering of the mechanical durability and sensitivity of the photoconductor is caused sometimes.

Specific examples of the phenolic compound according to the invention include the compounds represented by the following formulas, which should not be construed as limiting the scope of the invention.

(No. B-1)

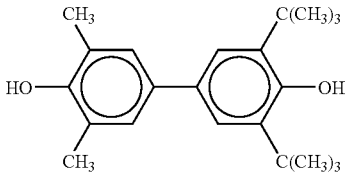

-continued (No. B-2)

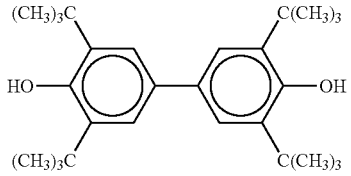

(No. B-3)

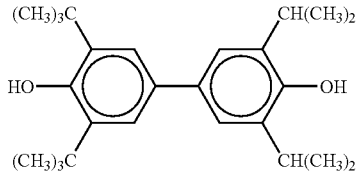

(No. B-4)

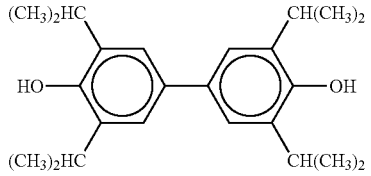

(No. B-5)

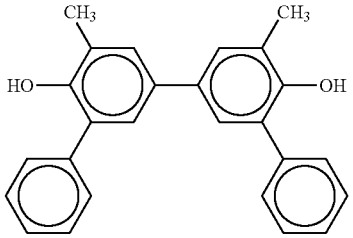

(No. B-6)

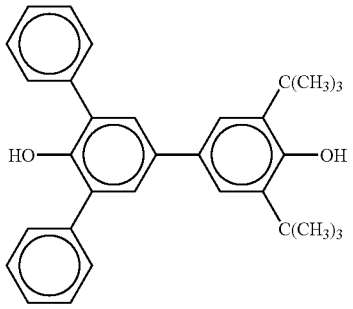

(No. B-7)

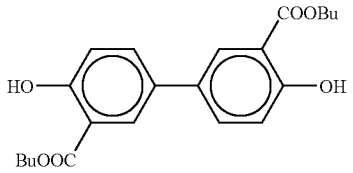

(No. B-8)

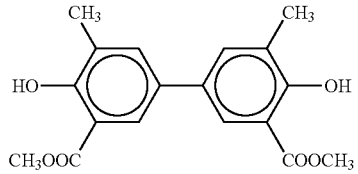

Heretofore, with respect to the novel aromatic polyester resin according to the invention, explanations have been given and, hereinafter, with respect to the electrophotographic photoconductor (hereinafter, referred to as only "photoconductor") in which the photosensitive layer comprises the above-noted novel aromatic polyester resin, explanations are given. FIGS. 1 to 6 are sectional views schematically showing examples of the layer composition of the photoconductor according to the invention.

The photoconductor according to the invention is a photoconductor in which the photosensitive layer 2 (or 2', 2", 2''', 2'''', 2''''') comprises one or more types of the above-noted aromatic polyester resins and depending on the applying manner of the photosensitive layer, photoconductors having various layer compositions shown in FIGS. 1 to 6 can be produced.

The layer composition of the photoconductor shown in FIG. 1 is an example of the layer composition in which the photosensitive layer 2 comprising a sensitizing dye, the aromatic polyester resin according to the invention and optionally a binding agent (binder resin) is disposed on the support 1. In this layer composition, the aromatic polyester resin according to the invention functions as a photo-electrical conductive substance and the formation and transfer of a charge carrier which is necessary for the damping of the light are performed through the aromatic polyester resin according to the invention. However, the aromatic polyester resin according to the invention has almost no absorption of the light in the visible region of the light, thus for forming the image using a visible light, it is necessary that by incorporating a sensitizing dye having an absorption of the light in the visible region of the light into the composition of the photosensitive layer, the photosensitive layer is sensitized.

Figure 2:
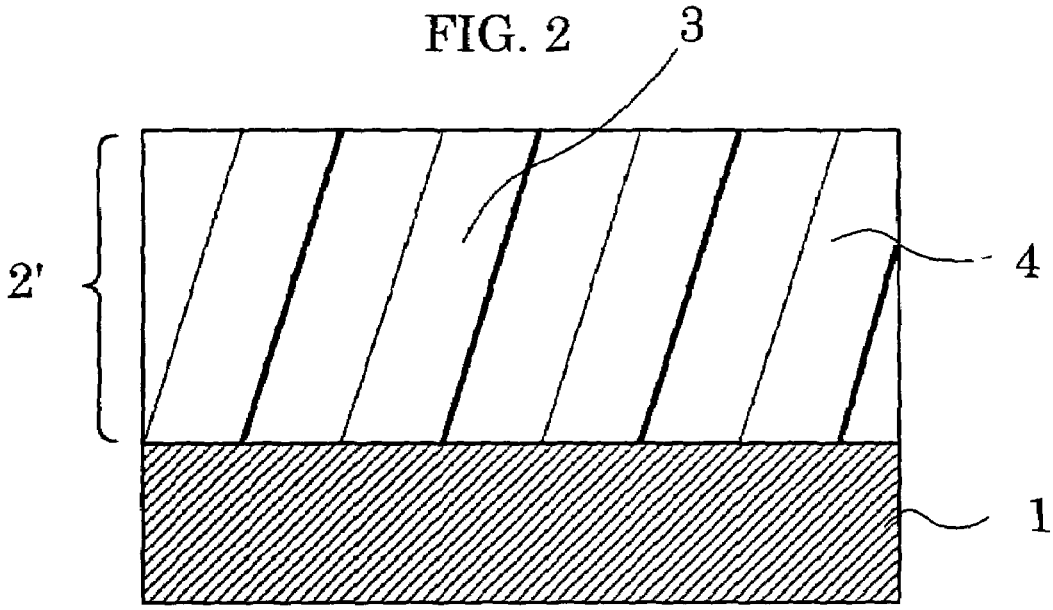
FIG. 2 is a cross sectional view schematically showing another example of the layer composition of the electrophotographic photoconductor according to the invention.

The layer composition of the photoconductor shown in FIG. 2 is an example of the layer composition in which the photosensitive layer 2' in which the charge generating substance 3 is dispersed in the charge transporting medium 4 comprising either the aromatic polyester resin according to the invention individually or the combination thereof with a binding agent, is disposed on the support 1. A preferred layer composition of the electrophotographic photoconductor for a liquid developing according to the invention is also the layer composition shown in FIG. 2. Here, while the aromatic polyester resin according to the invention individually or in the combination thereof with a binding agent forms a charge transporting medium, the charge generating substance 3 (e.g., an inorganic or organic pigment) generates a charge carrier. In this example, the charge transporting medium 4 accepts mainly a charge carrier generated by the charge generating substance 3 and undertakes the function of transporting the charge carrier. For this example of the photoconductor having the above-noted layer composition, it is an essential condition that the wavelength region for the light absorption of the charge generating substance and that of the aromatic polyester resin according to the invention are not overlapped onto each other. This is because, for causing the charge generating substance 3 to generate effectively the charge carrier, it is necessary that the light is transmitted to the surface of the charge generating substance 3. The aromatic polyester resin comprising the recurring unit represented by Formula (I) according to the invention has almost no light absorption in a range of the light wavelength of 600 nm or more and has a light absorption in the range of from a visible light region to a near infrared light region, thus it is a characteristic of the aromatic polyester resin according to the invention that when the aromatic polyester resin according to the invention is used in combination thereof with the charge generating substance 3 generating a charge carrier, the aromatic polyester resin according to the invention functions particularly effectively as a charge transporting medium or a charge transporting material. The charge transporting medium 4 may comprise a charge transporting material having a low molecular mass.

Figure 3:
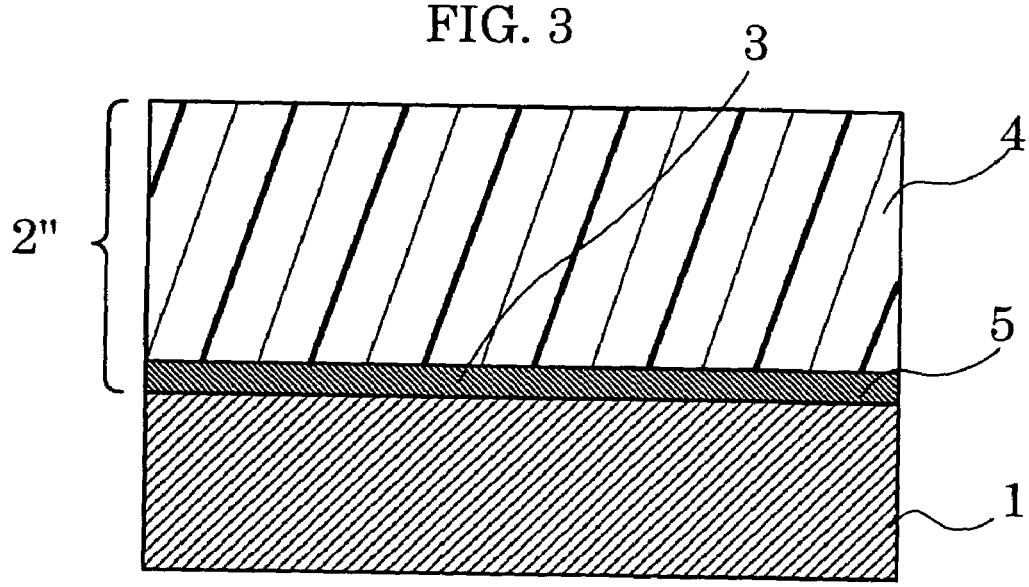
FIG. 3 is a cross sectional view schematically showing another example of the layer composition of the electrophotographic photoconductor according to the invention.

The layer composition of the photoconductor shown in FIG. 3 is an example of the layer composition in which the photosensitive layer 2" in a laminated layer composition comprising the charge generating layer 5 which comprises mainly the charge generating substance 3 and the charge transporting layer 4 which comprises the aromatic polyester resin according to the invention is disposed on the support 1. In this example, while a light transmitted through the charge transporting layer 4 reaches the charge generating layer 5 and in this layer, a charge carrier is generated, the charge transporting layer 4 accepts the charge carrier injected thereinto and transfers the charge carrier. Thus, the generating of the charge carrier which is necessary for the damping of the light is performed by the charge generating substance 3 and the transporting of the charge carrier is performed by the charge transporting layer 4. Such a mechanism is the same mechanism as that explained with respect to the example of the photoconductor shown in FIG. 2.

The charge transporting layer 4 is produced using the aromatic polyester resin according to the invention individually or in combination thereof with a binding agent. The aromatic polyester resin according to the invention is used also as a charge transporting medium or a charge transporting material having a low molecular mass and in this case, the charge transporting medium 4 may comprise a charge transporting material having a low molecular mass. For enhancing the charge generating efficiency, the charge generating layer 5 may comprise the aromatic polyester resin according to the invention. For enhancing the charge generating efficiency, also the photosensitive layer 2" may comprise a charge transporting material having a low molecular mass, as well as the below-noted photosensitive layers 2''' to 2'''''.

Figure 4:
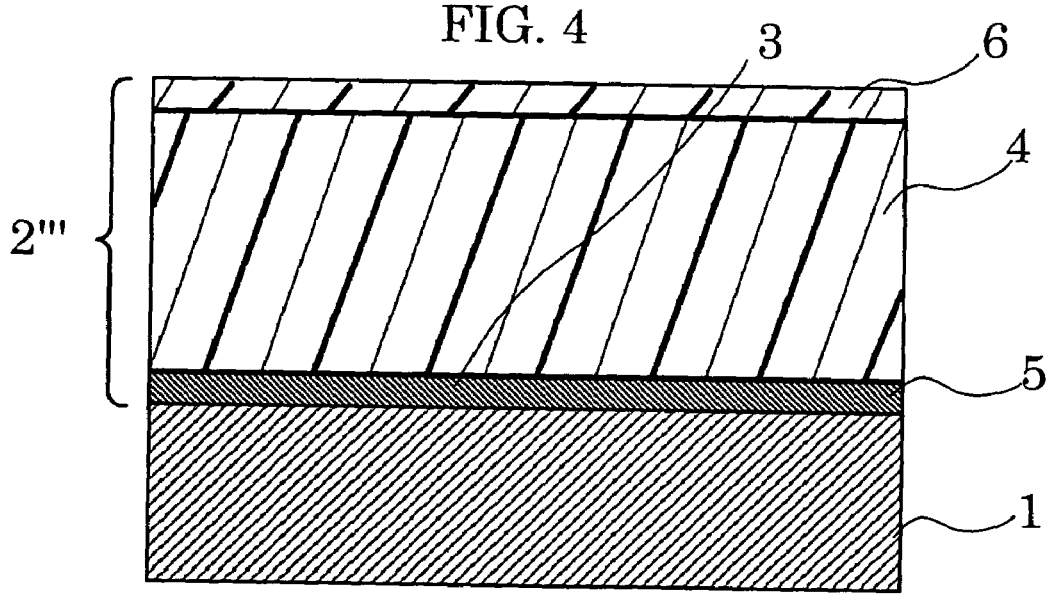
FIG. 4 is a cross sectional view schematically showing still another example of the layer composition of the electrophotographic photoconductor according to the invention.

The layer composition of the photoconductor shown in FIG. 4 is an example of the layer composition in which the protective layer 6 is disposed on the charge transporting layer 4. In this example, a protective layer is disposed on the charge transporting layer 4 using the aromatic polyester resin according to the invention individually or in combination thereof with a binding agent. Needless to say, it is effective that the protective layer is disposed on a charge transporting layer comprising a low-molecular-mass compound dispersed therein which is conventionally frequently used. On the photosensitive layer 2' shown in FIG. 2, also the protective layer may be disposed.

Figure 5:
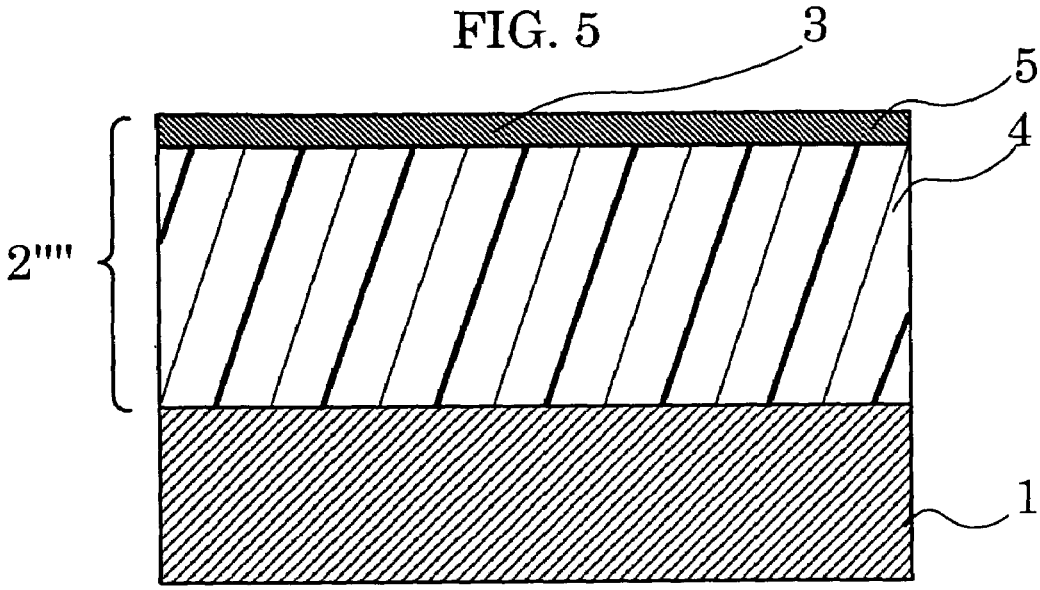
FIG. 5 is a cross sectional view schematically showing still another example of the layer composition of the electrophotographic photoconductor according to the invention.
Figure 6:
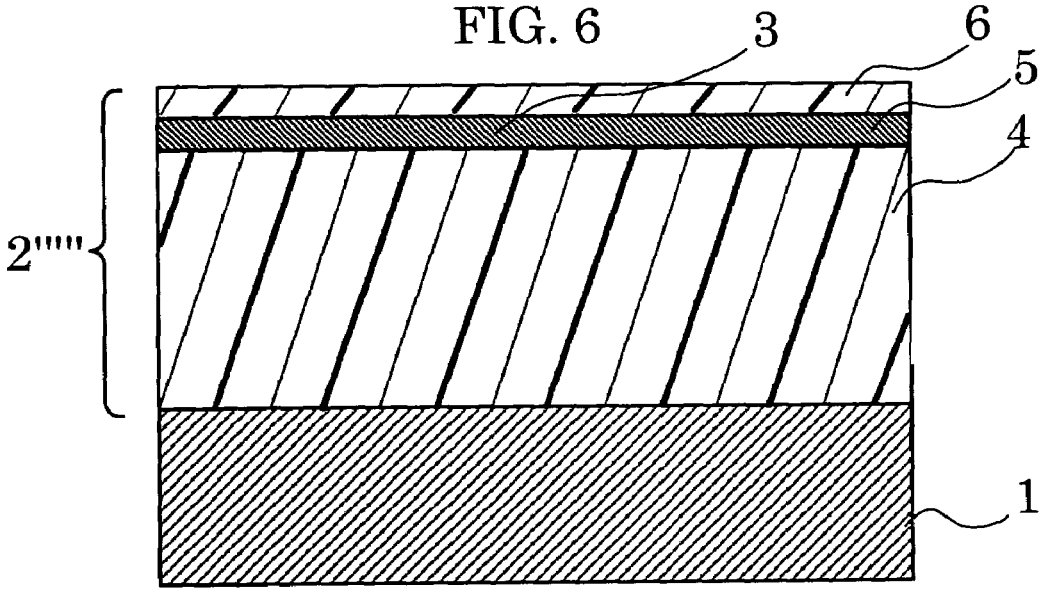
FIG. 6 is a cross sectional view schematically showing still another example of the layer composition of the electrophotographic photoconductor according to the invention.

The layer composition of the photoconductor shown in FIG. 5 is an example of the layer composition in which the photosensitive layer 2'''' comprising the charge generating layer 5 and the charge transporting layer 4 comprising the aromatic polyester resin according to the invention, which are disposed on the support 1 in a disposing order which is reverse to that in the example shown in FIG. 3 and the generating of a charge carrier and the mechanisms for transporting the charge carrier can be elucidated like in the above-noted example shown in FIG. 4. In this case, taking-into consideration the mechanical strength of the photoconductor, on the charge generating layer 5, the protective layer may be disposed as shown in FIG. 6.

For producing practically the photoconductor according to the invention, for example an example of the photoconductor shown in FIG. 1 is produced according to a method comprising preparing a coating liquid for disposing the photosensitive layer 2 by dissolving at least one type of the aromatic polyester resin according to the invention and optionally a biding agent or a charge transporting material in a solvent and by mixing a sensitizing dye to the resultant liquid; coating the support 1 with the above-prepared coating liquid; and drying the resultant coating, thereby disposing the photosensitive layer 2 on the support 1.

The amount of the aromatic polyester resin according to the invention in the photosensitive layer 2 is preferably 20% by mass to 100% by mass and the amount of the sensitizing dye in the photosensitive layer 2 is preferably 0.1% by mass to 5% by mass, more preferably 0.5% by mass to 3% by mass, based on the total mass of the photosensitive layer 2. Examples of the sensitizing dye include triaryl methane dyes, such as brilliant green, victoria blue B, methyl violet, crystal violet and acid red violet 6B; xanthene dyes, such as rhodamine B, rhodamine 6G, rhodamine G extra, eosin S, erythrosine, rose bengale, fluorescein; thiazine dyes, such as methylene blue; and cyanine dyes, such as cyanine.

For example, an example of the photoconductor shown in FIG. 2 is produced according to a method comprising: preparing a coating liquid for disposing the photosensitive layer 2' by dissolving one type or more types of the aromatic polyester resin according to the invention and optionally a binding agent or a charge transporting material in a solvent and by dispersing fine particles of the charge generating substance 3 in the resultant solution; coating the support 1 with the above-prepared coating liquid; and drying the resultant coating, thereby disposing the photosensitive layer 2' on the support 1.

The photosensitive layer 2' has a thickness of preferably 3 μm to 50 μm, more preferably 5 μm to 40 μm. The amount of the aromatic polyester resin according to the invention in the photosensitive layer 2' is preferably 20% by mass to 95% by mass and the amount of the charge generating substance 3 in the photosensitive layer 2' is preferably 0.1% by mass to 50% by mass, more preferably 1% by mass to 20% by mass, based on the total mass of the photosensitive layer 2'.

Examples of the charge generating substance 3 which can be incorporated in the composition of the photosensitive layer of the electrophotographic photoconductor for a dry or liquid developing according to the invention include inorganic materials, such as selenium, selenium-tellurium, cadmium sulfide, cadmium sulfide-selenium and α-silicon; and organic materials, such as C. I. pigment blue 25 (color index C. I. 21180); C. I. pigment red 41 (C. I. 21200); C. I. acid red 52 (C. I. 45100); C. I. basic red 3 (C. I. 45210); azo pigments, such as an azo pigment having a carbazole skeleton (see JP-A No. 53-95033), an azo pigment having a distyryl benzene skeleton (see JP-A No. 53-133445), an azo pigment having a triphenyl amine skeleton (see JP-A No. 53-132347), an azo pigment having a dibenzothiophene skeleton (see JP-A No. 54-21728), an azo pigment having an oxadiazole skeleton (see JP-A No. 54-12742), an azo pigment having a fluorenone skeleton (see JP-A No. 54-22834), an azo pigment having a bisstilbene skeleton (see JP-A No. 54-17733), an azo pigment having a distyryl oxadiazole skeleton (see JP-A No. 54-2129) and an azo pigment having distyryl carbazole skeleton (see JP-A No. 54-14967); phthalocyanine pigments, such as C. I. pigment blue 16 (C. I. 74100) and a titanyl phthalocyanine; indigo pigments, such as C. I. vat brown 5 (C. I. 73410) and C. I. vat dye (C. I. 73030); and perylene pigments, such as Algo scarlet B (manufactured by Bayer AG) and indanthrene scarlet R (manufactured by Bayer AG). These charge generating substances may be used individually or in combination.

A photoconductor having high sensitivity and high durability can be obtained by incorporating a combination of particularly a phthalocyanine pigment and another charge generating substance which are selected from the group consisting of the above-exemplified charge generating substances in the composition of the photosensitive layer. Examples of the phthalocyanine pigment include compounds having a phthalocyanine skeleton represented by the following Formula (N), wherein M represents any one of a metal (a center metal) and a nonmetal (hydrogen).

Formula (N)

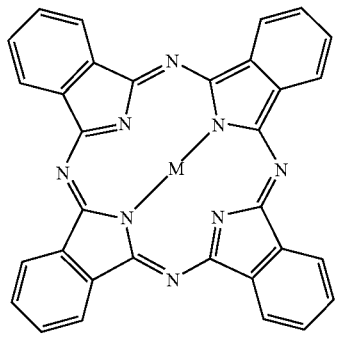

Examples of M include simple substances, such as H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Ti, La, Ce, Pr, Nd, Pm, Sm, Eu, Gd, Th, Dy, Ho, Er, Tm, Yb, Lu, Th, Pa, U, Np and Am; and compounds containing two or more elements, such as an oxide, a chloride, a fluoride, a hydroxide and a bromide. The center metal M is not restricted to the above-exemplified elements. The charge generating substance having a phthalocyanine skeleton according to the invention may be a charge generating substance having at least a basic skeleton represented by Formula (N) or also may be either a charge transporting material having an oligomer structure, such as a dimer or trimer, or a charge generating substance having a polymer structure. The above-noted basic skeleton may have various substituents.

Among the above-noted various phthalocyanines, an oxotitanium phthalocyanine having TiO as the center metal M and a metal-free phthalocyanine having H as the center metal M are particularly preferred from the viewpoint of photoconductor properties.

Moreover, these phthalocyanines are known to have various crystal forms. For example, an oxotitanium phthalocyanine has α-, β-, γ-, m- and y-crystal forms and a copper phthalocyanine has α-, β- and γ-crystal forms. Even in the case wherein plural phthalocyanines have the same center metal as that of each other, when the plural phthalocyanines have a different crystal form from that of each other, various properties of such plural phthalocyanines vary among the plural phthalocyanines. It is reported that among the above-noted various properties, the photoconductor properties vary depending on the variety of the crystal form of the phthalocyanine (see volume 29, No. 4 (1990) of a magazine by the Society of Electrophotography of Japan).

According to the above-noted report, each phthalocyanine has the optimal crystal form from the viewpoint of the photoconductor properties and particularly, the oxotitanium phthalocyanine is desired to have the Y-crystal form.

The charge generating substance may be used in a combination of two types of the charge generating substance having the phthalocyanine skeleton, or in a combination of the above-noted two types and further another type of the charge generating substance. In this case, examples of the charge generating substance used in the combination with the above-noted two types include an inorganic material and an organic material.

The amount of the charge generating substance in the photosensitive layer is preferably 0.1% by mass to 40% by mass, more preferably 0.3% by mass to 25% by mass, based on the total mass of the photosensitive layer. The amount of the charge generating substance is preferably 5% by mass to 95% by mass, based on the mass of the electron-hole transporting polymer.

Further, an example of the photoconductor shown in FIG. 3 is produced according to a method comprising disposing the charge generating layer 5 on the support 1 either by vacuum-metallizing the charge generating substance 3 or by coating the support 1 with a coating dispersion in which fine particles of the charge generating substance 3 are dispersed in a proper solvent dissolving optionally a binding agent, by drying the resultant coating, and optionally by surface-treating and controlling the thickness of the film as the charge generating layer 5; and disposing the charge transporting layer 4 by coating the charge generating layer 5 with a coating solution in which at least one type of the aromatic polyester resin and optionally a binding agent or a charge transporting material are dissolved in a solvent and by drying the resultant coating as the charge transporting layer.

Here, the charge generating substance used for disposing the charge generating layer 5 is the same charge generating substance as that explained in the above-noted section of producing method of the photosensitive layer 2'.

The charge generating layer 5 has a thickness of preferably 5 μm or less, more preferably 2 μm or less. The charge transporting layer 4 has a thickness of preferably 3 μm to 50 μm, more preferably 5 μm to 40 μm. With respect to a photoconductor comprising the charge generating layer 5 in which fine particles 3 of a charge generating substance are dispersed in a binding agent, the amount of fine particles 3 of a charge transporting material in the charge generating layer is preferably 10% by mass to 100% by mass, more preferably 50% by mass to 100% by mass, based on the total mass of the charge generating layer 5. Further, the amount of the aromatic polyester resin according to the invention having a charge transporting function in the charge transporting layer 4 is preferably 40% by mass to 100% by mass, based on the total mass of the charge transporting layer 4.

With respect to the photosensitive layer 2" shown in FIG. 3 may comprise a charge transporting material having a low molecular mass", explanations have been given above. The charge transporting material having a low molecular mass is used for controlling the charging properties and sensitivity of the photoconductor and examples of the charge transporting material having a low molecular mass include derivatives, such as an oxazol derivative, an oxadiazol derivative (see JP-A Nos. 52-139065 and 52-139066), an imidazol derivative, a triphenylamine derivative (see JP-A Nos. 3-285960 and 3-285961), a benzidine derivative (see JP-B No. 58-32372), an α-phenylstilben derivative (see JP-A No. 57-73075), a hydrazone derivative (see JP-A Nos. 55-154955, 55-156954, 55-52063 and 56-81850), a triphenylmethane derivative (see JP-B No. 51-10983), an anthracene derivative (see JP-A No. 51-94829), a styryl derivative (see JP-A Nos. 56-29245 and 58-198043), a carbazol derivative (see JP-A No. 58-58552) and a pyrene derivative (see JP-A No. 2-94812).

An example of the photoconductor shown in FIG. 4 is produced according to a method comprising disposing the protective layer 6 on the surface of the example of the photoconductor by coating the surface of an example of the photoconductor shown in FIG. 3 with a coating solution in which the aromatic polyester resin according to the invention and optionally a binding agent or a charge transporting material are dissolved in a proper solvent; and drying the resultant coating as the protective layer 6. The protective layer 6 has a thickness of preferably 0.15 μm to 10 μm. The amount of the aromatic polyester resin according to the invention in the protective layer is preferably 40% by mass to 100% by mass, based on the total mass of the protective layer 6.

An example of the photoconductor shown in FIG. 5 is produced according to a method comprising disposing the charge transporting layer 4 on the support 1 by coating the support 1 with a coating liquid in which the aromatic polyester resin according to the invention and optionally a binding agent or a charge transporting material are dissolved in a proper solvent and by drying the resultant coating as the charge transporting layer 4; and disposing the charge generating layer 5 on the charge transporting layer 4 by coating the charge transporting layer 4 according to a spraying coating with a coating dispersion in which fine particles 3 of a charge generating substance are dispersed in a solvent in which optionally a binding agent is dissolved. The amount mass ratio between the charge generating layer 5 and the charge transporting layer 4 is the same mass ratio as that explained above in the production method of an example of the photoconductor shown in FIG. 3.

By disposing the above-noted protective layer 6 on the charge generating layer 5 of the above-obtained photoconductor, an example of the photoconductor shown in FIG. 6 can be produced.

Further, in examples of the photoconductor in the layer compositions shown in FIGS. 1, 2, 3 and 5, the below-described conventional protective layer may be disposed.

Examples of the binding agent include all of insulating and adhesive resins, such as condensed resins, such as polyamide resins, polyurethane resins, polyester resins, epoxy resins, polyketone resins and polycarbonate resins; and vinyl resins, such as polyvinyl ketone resins, polystyrene resins, poly-N-vinyl carbazole resins and polyacrylamide resins. Examples of the plasticizing agent which is optionally added to the binding agent include halogenated paraffins, dimethylnaphthalene and dibutylphthalate. The charge transporting layer 4 may optionally comprise an additive, such as an anti-oxidant, a light stabilizer, a heat stabilizer and a lubricant.

The above-noted photosensitive layer may comprise optionally additives, such as plasticizers, anti-oxidants, light stabilizers, heat stabilizers and lubricants for improving the charging properties of the photoconductor. Examples of the plasticizers include halogenated paraffins, dimethylnaphthalene and dibutylphthalate. Examples of the anti-oxidants or light stabilizers include phenolic compounds, hydroquinone compounds, hindered phenolic compounds, hindered amine compounds and compounds in which a hindered amine and a hindered phenol are present simultaneously in one molecule.

Examples of the support 1 of the photoconductor include plates, drums and foils of metals, such as aluminum, nickel, copper, titanium, gold and stainless steel; plastic films metallized with metals, such as aluminum, nickel, copper, titanium, gold, tin oxide and indium oxide; and papers, plastic films and drums which are subjected to a conducting treatment of coating with a conductive substance.

Optionally, on the support 1, an intermediate layer may be disposed. Generally, the intermediate layer comprises mainly resins and taking-into consideration that the photosensitive layer is disposed on the intermediate layer comprising the above-noted resins by coating the intermediate layer with a coating liquid containing an organic solvent, the resins comprised in the intermediate layer are desired to have high resistance to general organic solvents. Examples of such resins include water-soluble resins, such as polyvinyl alcohol resins, casein resins and polyacrylate sodium; alcohol-soluble resins, such as nylon copolymers and methoxymethylated nylons; and curable resins which can form a three-dimensional net work, such as polyurethane resins, melamine resins, phenolic resins, alkyd-melamine resins and epoxy resins. The intermediate layer may comprise for preventing the moiré of the image or lowering the residual potential of the photoconductor, fine-particle pigment of metal oxides, such as titanium oxide, silica, alumina, zirconium oxide, tin oxide and indium oxide. The intermediate layer can be disposed, like the above-noted photosensitive layer using a proper solvent according to a proper coating method. Further, the intermediate layer according to the invention may comprise silane coupling agents, titanium coupling agents and chromium coupling agents. Besides the above-noted intermediate layers, preferred examples of the intermediate layer include an intermediate layer disposed by subjecting $Al_2O_3$ to an anodizing; an intermediate layer disposed by subjecting an organic compound, such as polyparaxylene resins to a vacuum thin-film layer; and an intermediate layer disposed by subjecting an inorganic compound, such as $SiO_2$, $SnO_2$, $TiO_2$, ITO and $CeO_2$ to a vacuum thin-film formation. Preferably, the intermediate layer has a thickness of 0 μm to 5 μm.

Further, a protective layer may be disposed on the photosensitive layer for improving the mechanical durability of the photoconductor, such as the wear resistance.

Examples of the material used for disposing the protective layer include ABS resins, ACS resins, olefin-vinylmonomer copolymers, chlorinated polyether resins, aryl resins, phenolic resins, polyacetal resins, polyamide resins, polyamide-imide resins, polyacrylate resins, polyallylsulfon resins, polybutylene resins, polybutyleneterephthalate resins, polycarbonate resins, polyethersulfone resins, polyethylene resins, polyethyleneterephthalate resins, polyimide resins, acrylic resins, polypropylene resins, polyphenyleneoxide resins, polysulfone resins, polystyrene resins, AS resins, butadiene-styrene copolymer resins, polyurethane resins, polyvinyl chloride resins, polyvinylidene chloride resins, and epoxy resins. The protective layer may comprise for improving the wear resistance of the photoconductor, fluorine-containing resins, such as polytetrafluoroethylene resins; silicone resins; and a dispersion in which an inorganic material, such as titanium oxide, tin oxide and potassium titanate is dispersed in the above-noted resins. The protective layer can be disposed according to an usual coating method. Preferably, the protective layer has a thickness of 0.1 μm to 10 μm. Besides the above-noted protective layers, a protective layer disposed by subjecting a conventional material, such as a-C and a-SiC to a vacuum thin-film formation method may be used.

Further, in the photoconductor produced according to the above-noted methods, between the support and the photosensitive layer, optionally an adhesive layer or a barrier layer may be disposed. Examples of the material used for disposing these layers include a polyamide resin, a nitrocellulose resin, aluminum oxide and titanium oxide. These layers have a thickness of preferably 1 μm or less.

The photoconductor according to the invention is produced according to a method comprising preparing a coating liquid for disposing the photosensitive layer in which the above-noted material is dissolved or dispersed in a proper organic solvent; disposing the photosensitive layer on the support by coating the support or the intermediate layer, which is optionally disposed between the support and the photosensitive layer, with the above-prepared coating liquid according to a dip coating, a blade coating or a spraying coating; and drying the resultant coating as the photosensitive layer. Optionally, the coating liquid may be prepared by dissolving or dispersing materials other than the charge generating substance in an organic solvent in which the charge generating substance has been dispersed beforehand. Examples of the above-noted dispersing method include a ball-mill dispersing method, an ultrasonic dispersing method and a homomixer dispersing method. Examples of the organic solvent used for preparing a coating dispersion or solution for disposing the photosensitive layer include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate, dioxane and dioxsolane.

The photosensitive layer may comprise a binding agent optionally for improving the charging properties, sensitivity and dispersion properties of the photosensitive layer.

The binding agent used in the disposing of the photosensitive layer is not restricted so long as the binding agent is a conventional binding agent for an electrophotographic photoconductor having high insulation quality. Examples of the binding agent include addition-polymerized resins, polyadded resins and polycondensed resins, such as polyethylene resins, polyvinyl butylal resins, polyvinyl formal resins, polystyrene resins, phenoxy resins, polypropylene resins, acrylic resins, methacrylic resins, vinyl chloride resins, vinyl acetate resins, epoxy resins, polyurethane resins, phenolic resins, polyester resins, alkyd resins, polycarbonate resins, polyamide resins, silicone resins and melamine resins; copolymer resins comprising two or more recurring units which are comprised in the above-noted resins, such as insulating resins, such as vinyl chloride-vinyl acetate copolymers, styrene-acryl copolymers and vinyl chloride-vinyl acetate-maleic anhydride copolymers; and organic semiconducting polymers, such as poly-N-vinyl carbazole resins. These binding agents may be used individually or in combination.

The photosensitive layer has a thickness of preferably 5 μm to 100 μm, more preferably 10 μm to 40 μm. When the thickness of the photosensitive layer is less than 5 μm, the charging properties of the photosensitive layer are lowered sometime. On the other hand, when the thickness of the photosensitive layer is more than 100 μm, the lowering of the sensitivity of the photosensitive layer is caused sometime.

The copying using the photoconductor according to the invention comprises charging the surface of the photoconductor, exposing, developing and optionally transferring to a transferring medium, such as a paper.

The photoconductor according to the invention has high sensitivity and is excellent in durability.

The electrophotographic photoconductor for a liquid developing according to the invention is excellent in resistance to a carrier solvent, charging properties and sensitivity and is preferably applied to from a low-speed copying process to a high-speed copying process. Further, by changing the type of the charge generating substance in the composition of the photosensitive layer, the spectral sensitivity of the photoconductor can be controlled, thus various types of the photoconductor according to the invention produced by changing the charge generating substance can be applied to from an analog copying machine for a monochrome or full-color to a photoconductor for a page printer using an LD light or LED light as a light for the recording. With respect to the photosensitive layer of the electrographic photoconductor for a liquid developing according to the invention, it is most important that as the charge transporting material, a charge transporting polymer is used. Particularly important is that as a polymer structure, an aromatic polyester structure having higher stability than that of a conventional polycarbonate structure is introduced. By the introduction thereof, an electrophotographic photoconductor having extremely high resistance to a carrier solvent used for a liquid developing and having practically-high sensitivity can be obtained. The reason thereof is at present uncertain, however is assumed as follows.

It is considered that since the charge transporting polymer having a specified structure according to the invention has high resistance to a carrier solvent used for a liquid developing, is a polymeric compound having a molecular mass which is a specified molecular mass or larger, and has an aromatic polyester structure having relatively-high crystallinity, the resistance of the photoconductor to a carrier solvent is further enhanced. It is also assumed that a compound having a low molecular mass, such as an acceptor compound having a specified structure or a phenolic compound having a specified structure which are present in the above-noted solid matrix of a charge transporting polymer, has an interaction of some kind with a charge transporting polymer and accordingly, the resistance of the electrophotographic photoconductor comprising the charge transporting polymer according to the invention, to a carrier solvent becomes extremely high.

As the above-noted interaction, with respect to the acceptor compound having a specific structure, an interaction based on a charge transporting polymer and an intermolecular charge transfer is assumed and with respect to the phenolic compound having a specific structure, an interaction based on a charge transporting polymer and a hydrogen bond or a van der Waals force is assumed. Further, for this interaction, the structural factors of the charge transporting polymer, acceptor compound and phenolic compound according to the invention is also important and it is assumed that by the synergism of these structural factors, the object of the invention which is a photoconductor having extremely high resistance to a carrier solvent can be obtained.

On the other hand, with respect to enhancing the sensitivity of the photoconductor, it is assumed that based on the above-noted interaction, an extremely homogeneous polymer matrix (dispersed in the molecule-order) is produced and a charge is injected from the charge generating substance into a charge-transfer matrix, thus a smooth charge transfer through the matrix is obtained and as a result, the sensitivity-enhancing of the photoconductor is obtained.

(Image-Forming Apparatus and Image-Forming Method)

The image-forming apparatus according to the invention comprises the electrophotographic photoconductor according to the invention or the electrophotographic photoconductor for a liquid developing, an electrostatic-latent-image forming unit, a developing unit, a transferring unit, a fixing unit and further, other units selected optionally and properly, such as a destaticizing unit, a cleaning unit, a recycling unit and a controlling unit.

The image-forming method according to the invention comprises forming an electrostatic-latent image, developing, transferring, fixing and other steps selected optionally and properly, such as destaticizing, cleaning, recycling and controlling.

The image-forming method according to the invention can be preferably performed by the image forming apparatus according to the invention; the forming of the electrostatic-latent image can be preferably performed by the electrostatic-latent-image forming unit; the developing can be preferably performed by the developing unit; the transferring can be preferably performed by the transferring unit; the fixing can be preferably performed by the fixing unit; and the other steps can be preferably performed by the other units.

Forming Electrostatic-Latent Image and Electrostatic-Latent-Image Forming Unit

The forming of the electrostatic-latent image is forming an electrostatic-latent image on an electrophotographic photoconductor. As the electrophotographic photoconductor, the electrophotographic photoconductor for a liquid developing according to the invention is used.

The forming of the electrostatic-latent image can be performed by the electrostatic-latent-image forming unit according to a method comprising charging uniformly the surface of the electrophotographic photoconductor; and exposing the surface of the electrophotographic photoconductor corresponding to the latent image.

The electrostatic-latent-image forming unit comprises a charging unit configured to charge uniformly the surface of the electrophotographic photoconductor; and an exposing unit configured to expose the surface of the electrophotographic photoconductor corresponding to the latent image.

The charging can be performed, for example using a charging unit by applying a voltage uniformly to the surface of the electrophotographic photoconductor.

The charging unit is not restricted and may be properly selected depending on the application. Examples of the charging unit include a non-contacting charging unit utilizing a corona discharge, such as a corotron and scorotron.

The exposing can be performed, for example using an exposing unit by exposing the surface of the electrophotographic photoconductor corresponding to the latent image.

The exposing unit is not restricted so long as the exposing unit can expose the surface of the electrophotographic photoconductor, which is charged by the charging unit corresponding to the image to be formed; and may be selected depending on the application. Examples of the exposing unit include a copying-optical exposer, a rod-lens-alley exposer, a laser-optical exposer and a crystal-liquid-shutter optical exposer.

Developing and Developing Unit

The developing is developing the electrostatic-latent image using a toner or a developing agent, thereby forming a visual image.

The forming of the visual image can be performed using the developing unit by developing the electrostatic-latent image using the toner or the developing agent.

The developing unit utilizes a liquid developing (wet developing) using a developing solution in which toner particles are dispersed in a solvent. Examples of the solvent include a hydrocarbon solvent, such as a so-called Isoper which is an aliphatic hydrocarbon, and a paraffin solvent; a silicone oil; and a fluorine-containing oil.

Transferring and Transferring Unit

The transferring is transferring the visual image to a recording medium.

The transferring is not restricted and may be properly selected depending on the application. However, the transferring has aspects, such as (1) an aspect in which the image is transferred directly to a recording medium, and (2) an aspect in which using an intermediate transferring medium, the visual image is primary-transferred to the intermediate transferring medium and thereafter, the visual image is secondary-transferred to the recording medium, wherein the aspect comprises the primary transferring in which the visual image is transferred to the intermediate transferring medium, thereby forming a compound-transferred image and the secondary transferring in which the compound-transferred image is transferred to a recording medium.

The transferring can be performed, for example using a transferring and charging unit by charging the surface of the electrophotographic photoconductor.

An example of the transferring unit comprises a transferring unit configured to peel and charge the visual image formed on the surface of the electrophotographic photoconductor to the recording medium. The transferring units may be used individually or in combination.

Examples of the transferring unit include a corona transferring unit utilizing a corona discharge.

The recording medium is not restricted so long as an unfixed image after the developing can be transferred to the recording medium and may be properly selected depending on the application. Examples thereof include a paper (representative) and a PET base for the OHP.

The fixing is fixing the visual image transferred to a recording medium using a fixing unit. The fixing may be performed with respect to the individual toners of respective colors transferred to the recording medium, or may be performed in one operation after the toners of all colors have been laminated.

The fixing apparatus is not restricted and may be properly selected depending on the application, however a conventional heating-pressing unit is preferred. Examples of the heating-pressing unit include a combination of a heating roller and a pressing roller and a combination of a heating roller, a pressing roller and an endless belt.

The heating using a heating-pressing unit is performed usually preferably at 80° C. to 200° C.

The destaticizing is destaticizing by applying a destaticizing bias to the electrophotographic photoconductor and can be preferably performed using a destaticizing unit.

The destaticizing unit is not restricted so long as the destaticizing unit can apply a destaticizing bias to the electrophotographic photoconductor and may be properly selected depending on the application from conventional destaticizing units. Preferred examples thereof include a destaticizing lamp.

The cleaning is removing the elctrophotographic toner remained on the electrophotographic photoconductor and can be preferably performed by a cleaning unit.

The cleaning unit is not restricted so long as the cleaning unit can remove an electrophotographic toner remained on the electrophotographic photoconductor and may be properly selected depending on the application from conventional cleaners. Preferred examples thereof include a magnetic brush cleaner, an electrostatic brush cleaner, a magnetic roller cleaner, a blade cleaner, a brush cleaner and a web cleaner.

The recycling is recycling the electrophotographic color toner removed by the above-noted cleaning to the above-noted developing unit and can be preferably performed by a recycling unit.

The recycling unit is not restricted and examples thereof include a conventional conveying unit.

The controlling is controlling each of the above-noted steps and can be preferably performed by a controlling unit.

The controlling unit is not restricted so long as the controlling unit can control operations of each of the above-noted units and may be selected depending on the application. Examples thereof include a device, such as a sequencer and a computer.

Hereinbelow, with respect to a wet developing system using a liquid developing agent according to the embodiment of the invention, explanations are given in detail.

Figure 7:
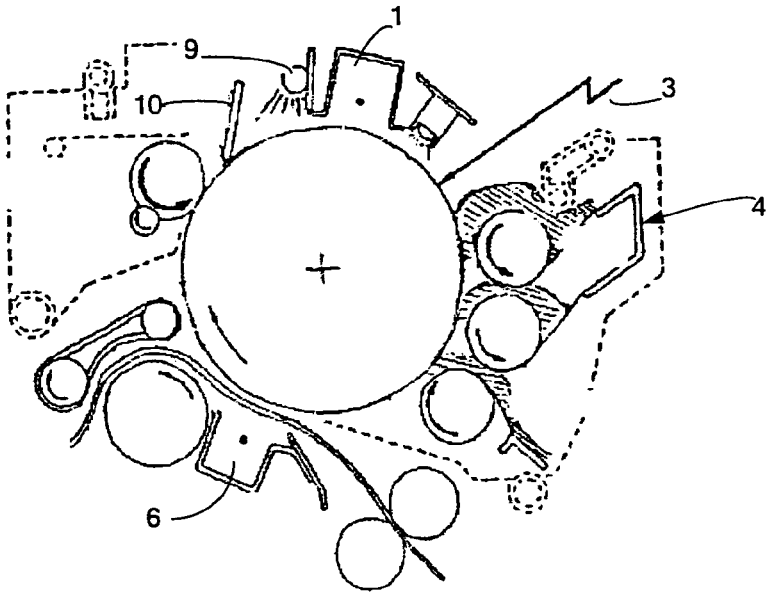
FIG. 7 is a view schematically showing an example of a liquid developing system using a liquid developing agent according to the invention.

FIG. 7 is a view schematically showing a liquid (wet) developing system using a liquid developing agent according to the electrophotography of the invention. The below-noted converted examples are also in the scope of the invention.

In FIG. 7, the photoconductor shown in the center of the FIG. is a photoconductor in the single layer composition in which a single-layered photosensitive layer is disposed on the support. The photoconductor may be in the form of besides a drum (shown in the FIG.), a sheet or an endless-belt. Examples of the charging charger 1 and the transferring charger 6 include a conventional charger, such as a corotron, a scorotron, a solid state charger and a charging roller.

Examples of the light source for the image exposing portion 3 and the destaticizing lamp 9 include a general luminescent body, such as a fluorescent lighting, a tungsten lamp, a halogen lamp, a mercury vapor lamp, a sodium lamp, a light emitting diode (LED), a semiconductor laser (LD) and an electroluminescence (EL). For irradiating only a light in a desired wavelength region, various filter, such as a sharp-cut filter, a band-pass filter, a near-infrared-cut filter, a dichroic filter, an interfering filter and a color-conversion filter can be used. In other steps than the steps shown in FIG. 7, such as transferring, destaticizing, cleaning and exposing which are performed in combination thereof with light-irradiating, the light is irradiated to the photoconductor.

The toner developed on the photoconductor is transferred by the developing unit 4 to a transferring paper, however, the whole amount of the toner on the photoconductor is not transferred to the paper, but a portion of the toner on the photoconductor is remained on the photoconductor. The remained potion of the toner is removed from the photoconductor using a fur brush or a cleaning blade 10. The cleaning is performed using only a cleaning brush sometimes. Examples of the cleaning brush include a conventional cleaning brush, such as a fur brush and a magfur brush.

When a positive (negative) charge is applied to the electrophotographic photoconductor and image exposure is performed, a positive (negative) electrostatic latent image will be formed on the photoconductor surface. If the latent image is developed with a toner (charge detecting particles) of negative (positive) polarity, a positive image will be obtained, and if the image is developed with a toner of positive (negative) polarity, a negative image will be obtained.

The novel aromatic polyester resin according to the invention functions effectively as a photo-electrical conductive material and is optically and chemically sensitized with a sensitizing agent, such as a dye and a lewis acid. Further, the novel aromatic polyester resin according to the invention is preferably used as a charge transporting medium or charge transporting material in the photosensitive layer of the electrophotographic photoconductor and is particularly useful as a charge transporting medium or charge transporting material in a function-divided photosensitive layer divided into two layers of the charge generating layer and the charge transferring layer.

The electrophotographic photoconductor according to the invention comprises in the photosensitive layer or in the most outer surface layer the above-noted novel aromatic polyester resin according to the invention having at least a charge transporting function as an effective component and is an electrophotographic photoconductor having high sensitivity and high durability. The electrophotographic photoconductor for a liquid developing according to the invention comprising a support, and a photosensitive layer in a single layer composition disposed on the support directly or through an intermediate layer, wherein the photosensitive layer comprises a charge generating substance, a charge transporting material and an acceptor compound and the charge transporting material is a charge transporting polymer represented by Formula (III), not only has extremely high resistance of the photosensitive layer to a carrier solvent used for a wet developing and high sensitivity, but also is practicable and is an electrophotographic photoconductor for a liquid developing which can be preferably applied to a wet developing system for enhancing the image quality.

Hereinbelow, the invention will be described in more detail with reference to the following Examples and Comparative Examples, which should not be construed as limiting the scope of the invention.

EXAMPLE A

Synthesis of Aromatic Polyester Resin 1.30 g of sodium hydroxide, 96 mg of sodium hydrosulfite and 48 ml of water were mixed and the resultant mixture was stirred while bubbling the mixture using a nitrogen gas, thereby dissolving sodium hydroxide and sodium hydrosulfite in water and obtaining a solution. To the obtained solution, 15 mg of 4-tert-butylphenol, 8 mg of benzyltriethylammonium chloride and 3.16 g of N-{4-[2,2-bis(4-hydroxyphenyl) vinyl] phenyl}-N,N-bis(4-tolyl) amine as a diol having a charge transporting function were added in this order and the resultant mixture was stirred for 30 minutes, thereby obtaining a solution. Separately, a solution in which 0.66 g of terephthalic acid chloride and 0.66 g of isophthalic acid chloride were dissolved in 40 ml of dichloromethane, was prepared and the solution was dropped into the above-noted solution at 20° C. during one hour, thereby obtaining a solution. Thereafter, the obtained solution was stirred at room temperature further for 4 hours and to the solution, 2.38 g of acetic acid, 100 ml of dichloromethane and 100 ml of water were added, followed by stirring the resultant mixture for 30 minutes. Thereafter, the stirring was stopped and the organic phase was separated. The organic phase was washed with an ion-exchanged water two times, with a 0.1 N aqueous solution of hydrochloric acid once, and further with an ion-exchanged water until the conductivity of the cleaning fluid became the same as that of an ion-exchanged water. The resultant organic phase was dropped into a large amount of methanol, thereby obtaining a polymer and the obtained polymer was dried at 80° C. under a reduced pressure, thereby obtaining 3.60 g of a yellow aromatic polyester resin (No. 1) represented by the following formula:

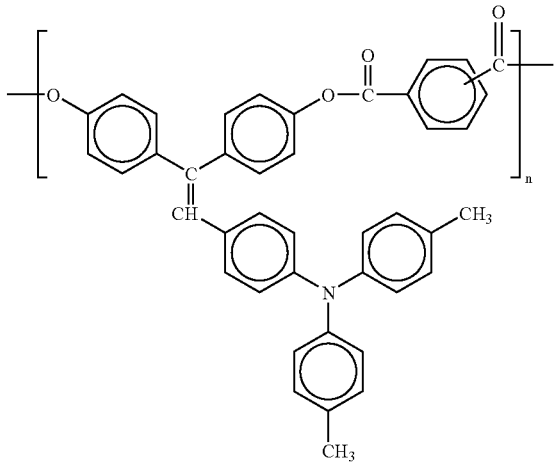

(Aromatic Polyester Resin No. 1)

Result of the elementary analysis (measured value (%)/calculated value (%))

C, 82.05/82.20, H, 5.01/5.09, N: 2.24/2.28

The molecular mass converted into the molecular mass as the polystyrene measured by the gel permeation chromatography.

Number average molecular mass: 13,300 Mass average molecular mass: 47,500.

Figure 8:
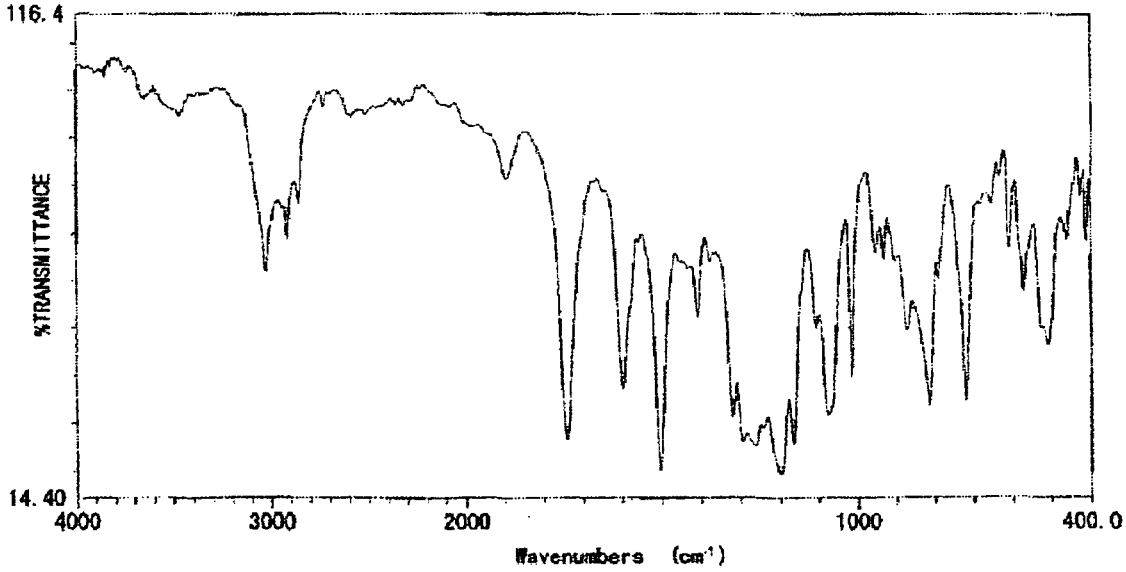
FIG. 8 is a graph showing an example of the infrared absorption spectrum measured with respect to the polyester resin produced in Synthesis Example 1.

The infrared absorption spectrum is shown in FIG. 8 and in the spectrum, a peak ascribed to a CO elongation-vibration (in an ester bond) was observed at 1743 $cm^{-1}$.

EXAMPLE B 1.28 g of sodium hydroxide, 96 mg of sodium hydrosulfite and 48 ml of water were mixed and the resultant mixture was stirred while bubbling the mixture using a nitrogen gas, thereby dissolving sodium hydroxide and sodium hydrosulfite in water and obtaining a solution. To the obtained solution, 21 mg of 2,4,6-trimethylphenol, 10 mg of benzyltriethylammonium chloride, 0.86 g of 1,1-bis(4-hydroxyphenyl) cyclohexane and 2.15 g of N-{4-[2,2-bis(4-hydroxyphenyl) vinyl] phenyl}-N,N-bis(4-tolyl) amine as a diol having a charge transporting function were added in this order and the resultant mixture was stirred for 30 minutes, thereby obtaining a solution. Separately, a solution in which 0.76 g of terephthalic acid chloride and 0.76 g of isophthalic acid chloride were dissolved in 40 ml of dichloromethane, was prepared and the solution was dropped into the above-noted solution at 20° C. during one hour, thereby obtaining a solution. Thereafter, the obtained solution was stirred at room temperature further for 4 hours and to the solution, 2.05 g of acetic acid, 100 ml of dichloromethane and 100 ml of water were added, followed by stirring the resultant mixture for 30 minutes. Thereafter, the stirring was stopped and the organic phase was separated. The organic phase was washed with an ion-exchanged water two times, with a 0.1 N aqueous solution of hydrochloric acid once, and further with an ion-exchanged water until the conductivity of the cleaning fluid became the same as that of an ion-exchanged water. The resultant organic phase was dropped into a large amount of methanol, thereby obtaining a polymer and the obtained polymer was dried at 80° C. under reduced pressure, thereby obtaining 3.42 g of a yellow aromatic polyester resin (No. 2) represented by the following formula:

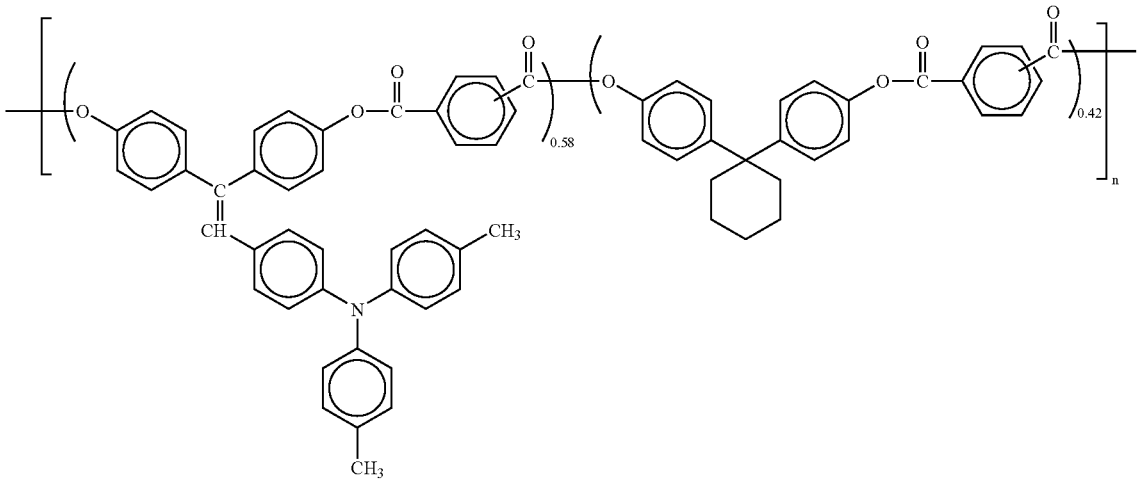

(Aromatic Polyester Resin No. 2)

Result of the elementary analysis (measured value (%)/calculated value

C, 80.80/80.98, H, 5.16/5.24, N, 1.51/1.56

The molecular mass converted into the molecular mass as the polystyrene measured by the gel permeation chromatography.

Number average molecular mass: 21,900 Mass average molecular mass: 122,700.

Figure 9:
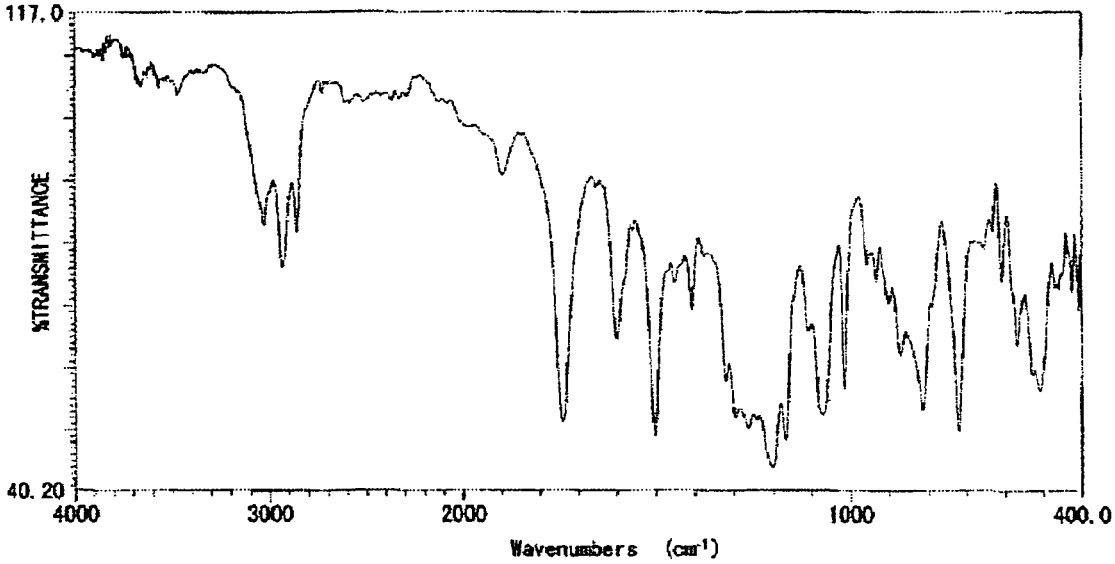
FIG. 9 is a graph showing an example of the infrared absorption spectrum measured with respect to the polyester resin produced in Synthesis Example 2.

The infrared absorption spectrum is shown in FIG. 9 and in the spectrum, a peak ascribed to a CO elongation-vibration (in an ester bond) was observed at 1741 $cm^{-1}$.

EXAMPLE C 1.34 g of sodium hydroxide, 96 mg of sodium hydrosulfite and 48 ml of water were mixed and the resultant mixture was stirred while bubbling the mixture using a nitrogen gas, thereby dissolving sodium hydroxide and sodium hydrosulfite in water and obtaining a solution. To the obtained solution, 22 mg of 2,4,6-trimethylphenol, 11 mg of benzyltriethylammonium chloride, 0.81 g of 2,2-bis(4-hydroxyphenyl) propane and 2.15 g of N-{4-[2,2-bis(4-hydroxyphenyl) vinyl] phenyl}-N,N-bis(4-tolyl) amine as a diol having a charge transporting function were added in this order and the resultant mixture was stirred for 30 minutes, thereby obtaining a solution. Separately, a solution in which 0.80 g of terephthalic acid chloride and 0.80 g of isophthalic acid chloride were dissolved in 40 ml of dichloromethane, was prepared and the solution was dropped into the above-noted solution at 20° C. during one hour, thereby obtaining a solution. Thereafter, the obtained solution was stirred at room temperature further for 4 hours and to the solution, 2.15 g of acetic acid, 100 ml of dichloromethane and 100 ml of water were added, followed by stirring the resultant mixture for 30 minutes. Thereafter, the stirring was stopped and the organic phase was separated. The organic phase was washed with an ion-exchanged water two times, with a 0.1 N aqueous solution of hydrochloric acid once, and further with an ion-exchanged water until the conductivity of the cleaning fluid became the same as that of an ion-exchanged water. The resultant organic phase was dropped into a large amount of methanol, thereby obtaining a polymer and the obtained polymer was dried at 80° C. under a reduced pressure, thereby obtaining 3.34 g of a yellow aromatic polyester resin (No. 3) represented by the following formula:

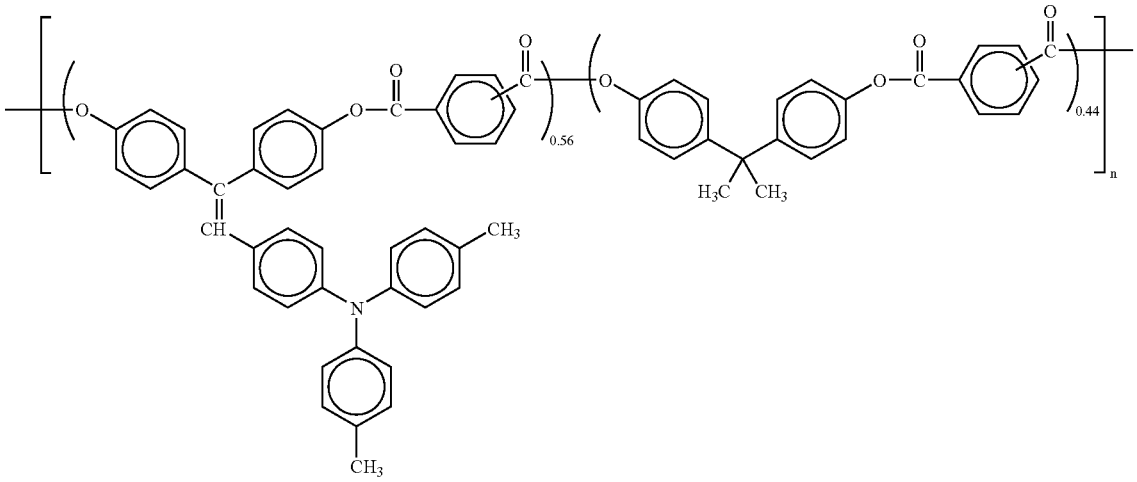

(Aromatic Polyester Resin No. 3)

Result of the elementary analysis (measured value (%)/calculated value

C, 80.70/80.57, H, 5.04/5.08, N, 1.67/1.56

The molecular mass converted into the molecular mass as the polystyrene measured by the gel permeation chromatography.

Number average molecular mass: 27,600 Mass average molecular mass: 202,700.

Figure 10:
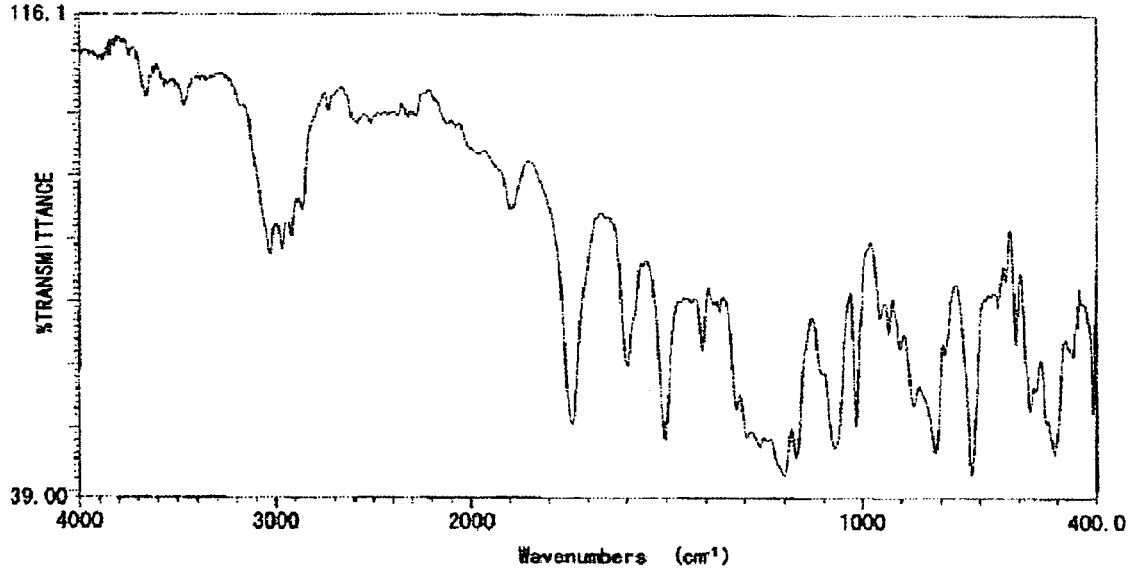
FIG. 10 is a graph showing an example of the infrared absorption spectrum measured with respect to the polyester resin produced in Synthesis Example 3.

The infrared absorption spectrum is shown in FIG. 10 and in the spectrum, a peak ascribed to a CO elongation-vibration (in an ester bond) was observed at 1741 $cm^{-1}$.

EXAMPLE D 1.30 g of sodium hydroxide, 96 mg of sodium hydrosulfite and 48 ml of water were mixed and the resultant mixture was stirred while bubbling the mixture using a nitrogen gas, thereby dissolving sodium hydroxide and sodium hydrosulfite in water and obtaining a solution. To the obtained solution, 21 mg of 2,4,6-trimethylphenol, 11 mg of benzyltriethylammonium chloride, 0.84 g of 2,2-bis(4-hydroxy-3-methylphenyl) propane and 2.15 g of N-{4-[2,2-bis(4-hydroxyphenyl) vinyl] phenyl}-N,N-bis(4-tolyl) amine as a diol having a charge transporting function were added in this order and the resultant mixture was stirred for 30 minutes, thereby obtaining a solution. Separately, a solution in which 0.77 g of terephthalic acid chloride and 0.77 g of isophthalic acid chloride were dissolved in 40 ml of dichloromethane, was prepared and the solution was dropped into the above-noted solution at 20° C. during one hour, thereby obtaining a solution. Thereafter, the obtained solution was stirred at room temperature further for 4 hours and to the solution, 2.08 g of acetic acid, 100 ml of dichloromethane and 100 ml of water were added, followed by stirring the resultant mixture for 30 minutes. Thereafter, the stirring was stopped and the organic phase was separated. The organic phase was washed with an ion-exchanged water two times, with a 0.1 N aqueous solution of hydrochloric acid once, and further with an ion-exchanged water until the conductivity of the cleaning fluid became the same as that of an ion-exchanged water. The resultant organic phase was dropped into a large amount of methanol, thereby obtaining a polymer and the obtained polymer was dried at 80° C. under reduced pressure, thereby obtaining 3.43 g of a yellow aromatic polyester resin (No. 4) represented by the following formula:

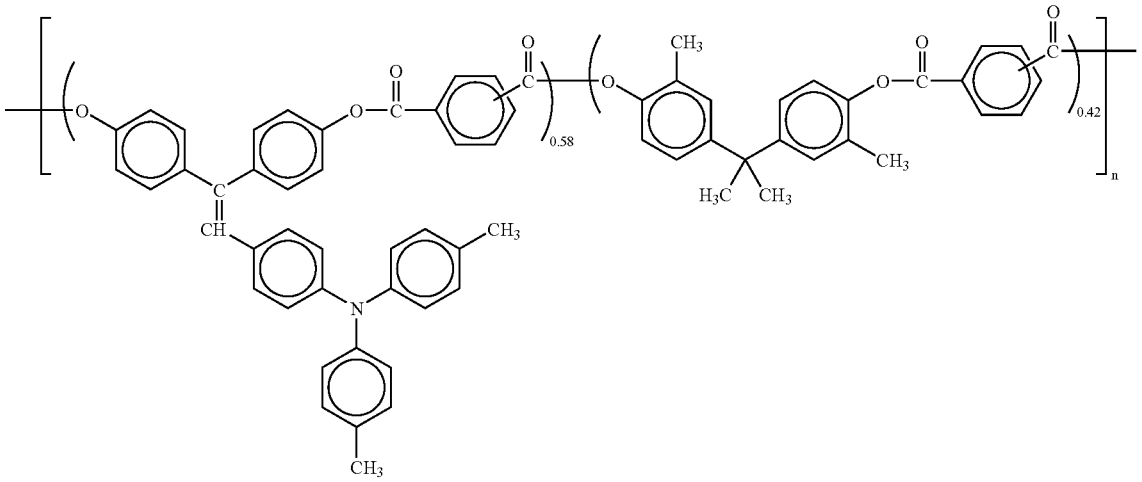

(Aromatic Polyester Resin No. 4)

Result of the elementary analysis (measured value (%)/calculated value

C, 80.78/80.77, H, 5.20/5.30, N, 1.50/1.56

The molecular mass converted into the molecular mass as the polystyrene measured by the gel permeation chromatography.

Number average molecular mass: 25,400 Mass average molecular mass: 147,000.

Figure 11:
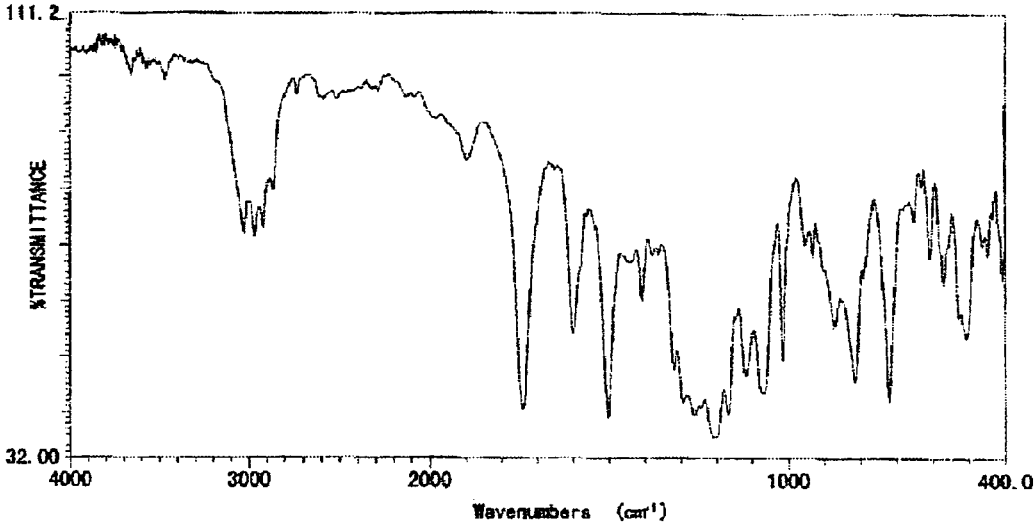
FIG. 11 is a graph showing an example of the infrared absorption spectrum measured with respect to the polyester resin produced in Synthesis Example 4.

The infrared absorption spectrum is shown in FIG. 11 and in the spectrum, a peak ascribed to a CO elongation-vibration (in an ester bond) was observed at 1741 $cm^{-1}$.

EXAMPLE E 1.34 g of sodium hydroxide, 96 mg of sodium hydrosulfite and 48 ml of water were mixed and the resultant mixture was stirred while bubbling the mixture using a nitrogen gas, thereby dissolving sodium hydroxide and sodium hydrosulfite in water and obtaining a solution. To the obtained solution, 22 mg of 2,4,6-trimethylphenol, 11 mg of benzyltriethylammonium chloride, 0.81 g of 4,4'-dihyroxy-3,3'-dimethyldiphenyl ether and 2.15 g of N-{4-[2,2-bis(4-hydroxyphenyl) vinyl] phenyl}-N,N-bis(4-tolyl) amine as a diol having a charge transporting function were added in this order and the resultant mixture was stirred for 30 minutes, thereby obtaining a solution. Separately, a solution in which 0.80 g of terephthalic acid chloride and 0.80 g of isophthalic acid chloride were dissolved in 40 ml of dichloromethane, was prepared and the solution was dropped into the above-noted solution at 20° C. during one hour, thereby obtaining a solution. Thereafter, the obtained solution was stirred at room temperature further for 4 hours and to the solution, 2.15 g of acetic acid, 100 ml of dichloromethane and 100 ml of water were added, followed by stirring the resultant mixture for 30 minutes. Thereafter, the stirring was stopped and the organic phase was separated. The organic phase was washed with an ion-exchanged water two times, with a 0.1 N aqueous solution of hydrochloric acid once, and further with an ion-exchanged water until the conductivity of the cleaning fluid became the same as that of an ion-exchanged water. The resultant organic phase was dropped into a large amount of methanol, thereby obtaining a polymer and the obtained polymer was dried at 80° C. under reduced pressure, thereby obtaining 3.17 g of a yellow aromatic polyester resin (No. 5) represented by the following formula:

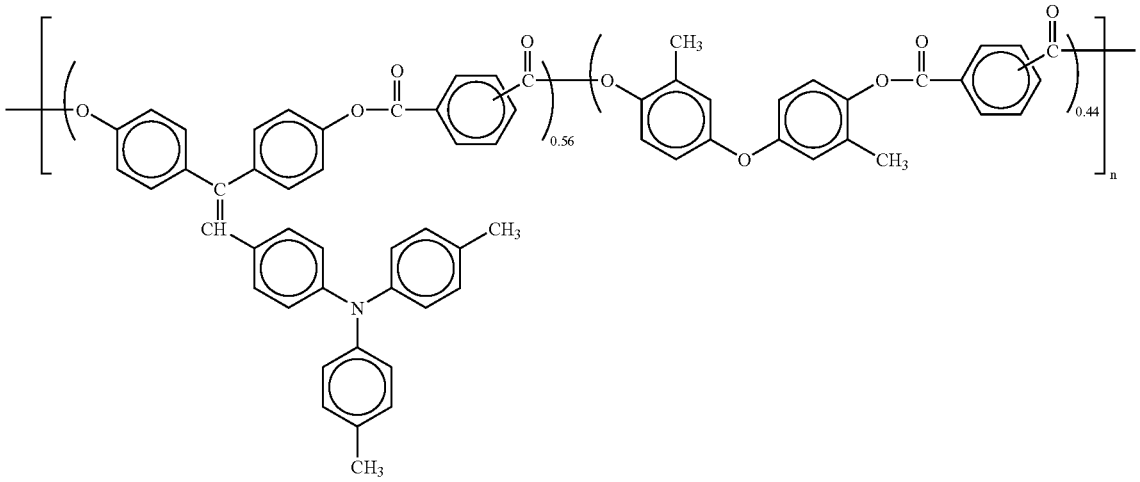

(Aromatic Polyester Resin No. 5)

Result of the elementary analysis (measured value (%)/calculated value

C, 79.41/97.38, H, 5.03/4.90, N, 1.50/1.56

The molecular mass converted into the molecular mass as the polystyrene measured by the gel permeation chromatography.

Number average molecular mass: 24,600 Mass average molecular mass: 219,800.

Figure 12:
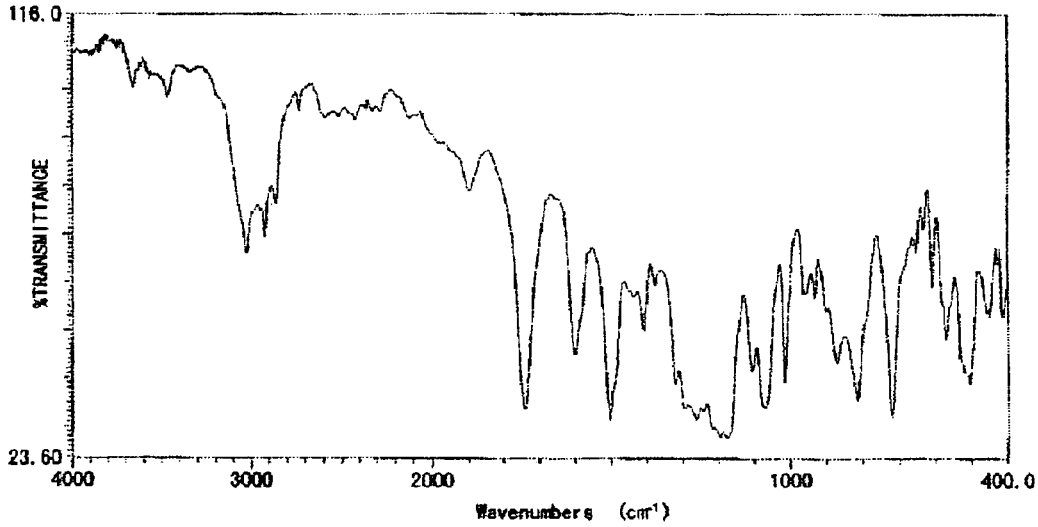
FIG. 12 is a graph showing an example of the infrared absorption spectrum measured with respect to the polyester resin produced in Synthesis Example 5.

The infrared absorption spectrum is shown in FIG. 12 and in the spectrum, a peak ascribed to a CO elongation-vibration (in an ester bond) was observed at 1741 $cm^{-1}$.

EXAMPLE 1

Production of Electrophotogarphic Photoconductor

The support of an aluminum plate was coated with a polyamide resin (trade name: CM-8000; manufactured by Toray Industries, Inc.) solution in which the polyamide resin was dissolved in a solvent mixture of methanol/butanol using a doctor blade and the resultant coating was dried at 100° C. for 5 minutes, thereby disposing an intermediate layer having a thickness of 0.5 μm. The obtained intermediate layer was coated with a dispersion produced by grinding a bisazo compound represented by the following Formula (P-1) as a charge transporting material in a solvent mixture of cyclohexane and 2-butanone using a ball-mill, using a doctor blade and the resultant coating was naturally dried, thereby disposing a charge generating layer having a thickness of 0.5 μm.

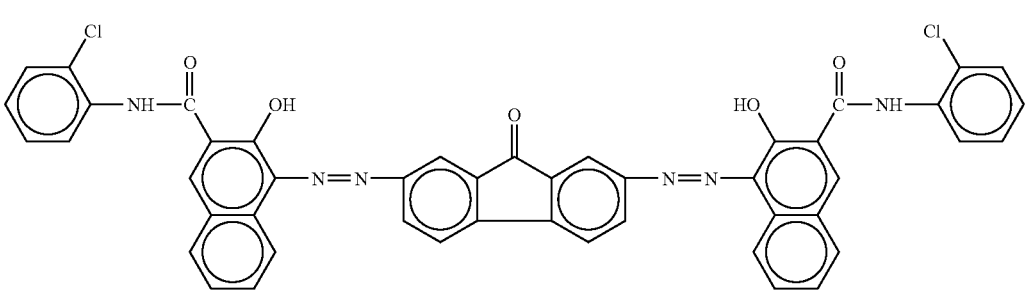

(P-1)

Next, the above-disposed charge generating layer was coated with a solution in which 1 part of the aromatic polyester resin (No. 1) having a charge transporting function which was obtained in Example A was dissolved in 4 parts of tetrahydrofuran, using a doctor blade and the resultant coating was dried naturally, at 80° C. for 5 minutes and at 120° C. for 20 minutes, thereby disposing the charge transporting layer having a thickness of 20 μm and producing the photoconductor No. 1.

EXAMPLE 2

The photoconductor No. 2 was produced in substantially the same manner as in Example 1, except that the aromatic polyester resin (No. 1) produced in Example A was changed to the aromatic polyester resin (No. 2) produced in Example B.

EXAMPLE 3

The photoconductor No. 3 was produced in substantially the same manner as in Example 1, except that the aromatic polyester resin (No. 1) produced in Example A was changed to the aromatic polyester resin (No. 3) produced in Example C.

EXAMPLE 4

The photoconductor No. 4 was produced in substantially the same manner as in Example 1, except that the aromatic polyester resin (No. 1) produced in Example A was changed to the aromatic polyester resin (No. 4) produced in Example D.

EXAMPLE 5

The photoconductor No. 5 was produced in substantially the same manner as in Example 1, except that the aromatic polyester resin (No. 1) produced in Example A was changed to the aromatic polyester resin (No. 5) produced in Example E.

COMPARATIVE EXAMPLE 1

After the intermediate layer and the charge generating layer were disposed on the support in substantially the same manner as in Example 1, the charge generating layer was coated with a solution in which 1 part of a charge transporting material represented by the following Formula (D-1) and 1 part of polycarbonate resin Z (trade name: PC-Z, manufactured by Teijin Chemicals Ltd.) were dissolved in 8 parts of tetrahydrofuran, using a doctor blade and the resultant coating was dried naturally, at 80° C. for 5 minutes and at 120° C. for 20 minutes, thereby disposing the charge transporting layer having a thickness of 20 μm and producing the comparative photoconductor No. 1.

(D-1)

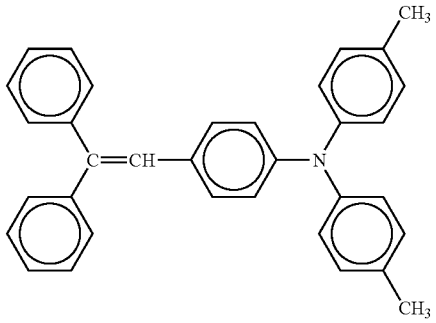

EXAMPLE 6

The photoconductor No. 6 was produced in substantially the same manner as in Example 1, except that the charge generating layer was disposed on the intermediate layer by coating the intermediate layer with a dispersion in which 3 parts of a X-type metal-free phthalocyanine as a charge generating substance and 2 parts of a polyvinyl butylal resin (trade name: BM-S: manufactured by Sekisui Chemical Co., Ltd.) were ground in 328 parts of tetrahydrofuran using a ball-mill, using a doctor blade; and by drying the resultant coating as the charge generating layer naturally, thereby disposing the charge generating layer having a thickness of 0.5 μm.

EXAMPLE 7

The photoconductor No. 7 was produced in substantially the same manner as in Example 2, except that the charge generating layer was disposed on the intermediate layer by coating the intermediate layer with a dispersion in which 3 parts of a X-type metal-free phthalocyanine as a charge generating substance and 2 parts of a polyvinyl butylal resin (trade name: BM-S: manufactured by Sekisui Chemical Co., Ltd.) were ground in 328 parts of tetrahydrofuran using a ball-mill, using a doctor blade; and by drying the resultant coating as the charge generating layer naturally, thereby disposing the charge generating layer having a thickness of 0.5 μm.

EXAMPLE 8

The photoconductor No. 8 was produced in substantially the same manner as in Example 3, except that the charge generating layer was disposed on the intermediate layer by coating the intermediate layer with a dispersion in which 3 parts of a X-type metal-free phthalocyanine as a charge generating substance and 2 parts of a polyvinyl butylal resin (trade name: BM-S: manufactured by Sekisui Chemical Co., Ltd.) were ground in 328 parts of tetrahydrofuran using a ball-mill, using a doctor blade; and by drying the resultant coating as the charge generating layer naturally, thereby disposing the charge generating layer having a thickness of 0.5 μm.

EXAMPLE 9

The photoconductor No. 9 was produced in substantially the same manner as in Example 4, except that the charge generating layer was disposed on the intermediate layer by coating the intermediate layer with a dispersion in which 3 parts of a X-type metal-free phthalocyanine as a charge generating substance and 2 parts of a polyvinyl butylal resin (trade name: BM-S: manufactured by Sekisui Chemical Co., Ltd.) were ground in 328 parts of tetrahydrofuran using a ball-mill, using a doctor blade; and by drying the resultant coating as the charge generating layer naturally, thereby disposing the charge generating layer having a thickness of 0.5 μm.

EXAMPLE 10

The photoconductor No. 10 was produced in substantially the same manner as in Example 5, except that the charge generating layer was disposed on the intermediate layer by coating the intermediate layer with a dispersion in which 3 parts of a X-type metal-free phthalocyanine as a charge generating substance and 2 parts of a polyvinyl butylal resin (trade name: BM-S: manufactured by Sekisui Chemical Co., Ltd.) were ground in 328 parts of tetrahydrofuran using a ball-mill, using a doctor blade; and by drying the resultant coating as the charge generating layer naturally, thereby disposing the charge generating layer having a thickness of 0.5 μm.

COMPARATIVE EXAMPLE 2

After the intermediate layer and the charge generating layer were disposed on the support in substantially the same manner as in Example 6, the charge generating layer was coated with a solution in which 1 part of a charge transporting material represented by the above-noted Formula (D-1) and 1 part of polycarbonate resin Z (trade name: PC-Z, manufactured by Teijin Chemicals Ltd.) were dissolved in 8 parts of tetrahydrofuran, using a doctor blade and the resultant coating was dried naturally, at 80° C. for 5 minutes and at 120° C. for 20 minutes, thereby disposing the charge transporting layer having a thickness of 20 μm and producing the comparative photoconductor No. 2.

The static properties of the electrophotographic photoconductor in a laminated layer composition was measured in terms of the surface potential V0(V) with respect to each of photoconductors Nos. 1 to 10 and comparative photoconductors Nos. 1 and 2 using a commercially-available testing apparatus for the static copying paper (trade name: EPA-8200; manufactured by Kawaguchi Electric Works Co., Ltd.), while preparing the sample for the measurement in such a manner that each of photoconductors Nos. 1 to 10 and comparative photoconductors Nos. 1 and 2 was charged by subjecting the photoconductor to a corona discharge having a voltage of −6 KV for 20 seconds and each photoconductor was left to stand in a dark place. Next, to each photoconductor, a light of a tungsten lamp was irradiated so that the illuminance at the surface of the photoconductor became 4.5 lux, thereby measuring the time (sec) until V0 became ½ and calculating the exposure ½ (lux-sec). The result of the measurement and calculation is shown in Table 2.

TABLE 2

| | Photoconductor No. | $V_0$ (V) | $E_{1/2}$ (lux · sec) |
|---|---|---|---|
| Example 1 | No. 1 | −795 | 0.86 |
| Example 2 | No. 2 | −1097 | 0.89 |
| Example 3 | No. 3 | −1226 | 1.02 |
| Example 4 | No. 4 | −992 | 0.90 |
| Example 5 | No. 5 | −1327 | 0.98 |
| Comp. Example 1 | Comp. No. 1 | −943 | 1.08 |
| Example 6 | No. 6 | −887 | 0.84 |
| Example 7 | No. 7 | −957 | 1.00 |
| Example 8 | No. 8 | −991 | 0.89 |
| Example 9 | No. 9 | −903 | 0.96 |
| Example 10 | No. 10 | −1033 | 0.95 |
| Comp. Example 2 | Comp. No. 2 | −727 | 1.10 |

EXAMPLE 11

The support of an aluminum plate was coated with a resin solution in which a polyamide resin (trade name: CM-8000; manufactured by Toray Industries, Inc.) was dissolved in a solvent mixture of methanol/butanol, using a doctor blade and the resultant coating was dried at 100° C. for 5 minutes, thereby disposing the intermediate layer having a thickness of 0.5 μm. Next, 1 part of a X-type metal-free phthalocyanine and a solution comprising 1 part of the aromatic polyester resin (No. 2) having a charge transporting function produced in (Example B) and 38 parts of tetrahydrofuran were dispersed using a ball-mill and to the resultant dispersion, the aromatic polyester resin (No. 2) having a charge transporting function, an acceptor compound represented by the following Formula (A-1), tetrahydrofuran and a silicone oil (trade name: KF 50; manufactured by Sin-Etsu Chemical Co., Ltd.) were added so that in the dispersion, the contents of the pigment, the aromatic polyester resin (No. 2) having a charge transporting function, the acceptor compound and the silicone oil were respectively 2% by mass, 60% by mass, 18% by mass and 0.001% by mass, thereby preparing a coating liquid for disposing the photosensitive layer, which had a solid content of 20% by mass. With the thus prepared coating liquid for disposing the photosensitive layer, the above-disposed intermediate layer was coated using a doctor blade and the resultant coating as the photosensitive layer was dried at 80° C. for 5 minutes, at 120° C. for 20 minutes, thereby disposing the photosensitive layer having a thickness of 20 μm and producing the electrophotographic photoconductor in a single layer composition (No. 11).

Formula (A-1)

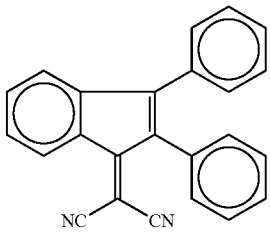

EXAMPLE 12

The electrophotographic photoconductor in a single layer composition (No. 12) was produced in substantially the same manner as in Example 11, except that the aromatic polyester resin (No. 2) produced in (Example B) was changed to the aromatic polyester resin (No. 4) produced in (Synthesis Example 4).

COMPARATIVE EXAMPLE 3

The intermediate layer was disposed in substantially the same manner as in Example 11. Next, 1 part of a X-type metal-free phthalocyanine and a solution comprising 1 part of a polycarbonate resin Z (trade name: PC-Z; manufactured by Teijin Chemicals Ltd.) and 38 parts of tetrahydrofuran were dispersed using a ball-mill and to the resultant dispersion, the charge transporting material having a low molecular mass which is represented by Formula (D-1), the acceptor compound represented by Formula (A-1), tetrahydrofuran and a silicone oil (trade name: KF 50; manufactured by Sin-Etsu Chemical Co., Ltd.) were added so that in the dispersion, the contents of the charge transporting material having a low molecular mass, the acceptor compound and the silicone oil were respectively 30% by mass, 18% by mass and 0.001% by mass, thereby preparing a coating liquid for disposing the photosensitive layer, which had a solid content of 20% by mass. The above-noted intermediate layer was coated with the above-prepared coating liquid for disposing the photosensitive layer using a doctor blade and the resultant coating as the photosensitive layer was dried at 80° C. for 5 minutes, at 120° C. for 20 minutes, thereby disposing the photosensitive layer having a thickness of 20 μm and producing the electrophotographic photoconductor in a single layer composition (comparative No. 3).

<Evaluation 1>

The static properties of the electrophotographic photoconductor in a single layer composition was measured in terms of the surface potential V0(V) with respect to each of photoconductors Nos. 11 and 12 and comparative photoconductor No.

3 using a commercially-available testing apparatus for the static copying paper (trade name: EPA-8200; manufactured by Kawaguchi Electric Works Co., Ltd.), while preparing the sample for the measurement in such a manner that each of photoconductors Nos. 11 and 12 and comparative photoconductor No. 3 was charged with an applying voltage of +6 kV for 20 seconds and each photoconductor was left to stand in a dark place for 20 seconds. Next, to each sample of the photoconductor, a single-color light having a wavelength of 780 nm was irradiated so that the illuminance at the surface of the photoconductor became 2.5 μW/cm$^2$, thereby measuring the half decay exposure ($E_{m1/m2}$ (μJ/cm$^2$)) which is required for reducing 800 V of the surface potential of the photoconductor to 400 V as the sensitivity of the photoconductor in the LD source region (near infrared region). The result of the measurement is shown in Table 3.

TABLE 3

| | Photoconductor No. | $V_0$ (V) | $E_{m1/2}$ (μJ/cm$^2$) |
|---|---|---|---|
| Example 11 | No. 11 | 876 | 0.30 |
| Example 12 | No. 12 | 810 | 0.31 |
| Comparative Example 3 | comparative No. 3 | 866 | 0.35 |

<Evaluation 2>

Each of the electrophotographic photoconductors in a single layer composition Nos. 11 and 12 and comparative No. 3 produced in Examples 11 and 12 and Comparative Example 3 was fitted in a drum rotating at a linear speed of 260 mm/s and was subjected to 5,000 sets of the treatment comprising positive-charging, exposing and light-quenching, thereby measuring the charged potential Vd (V) and the potential after the exposing. The result of the measurement is shown in Table 4.

TABLE 4

| | Charged Potential (V) | | Potential after Exposing (V) | |
|---|---|---|---|---|
| | Initial | After printing of 5,000 sheets | Initial | After printing of 5,000 sheets |
| Example 11 | 944 | 903 | 30 | 59 |
| Example 12 | 865 | 815 | 33 | 65 |
| Comparative Example 3 | 941 | 825 | 36 | 80 |

EXAMPLE 13

The support of an aluminum plate was coated with a resin solution in which a polyamide resin (trade name: CM-8000; manufactured by Toray Industries, Inc.) was dissolved in a solvent mixture of methanol/butanol, using a doctor blade and the resultant coating was dried at 100° C. for 5 minutes, thereby disposing the intermediate layer having a thickness of 0.5 μm. Next, 0.5 g of a X-type metal-free phthalocyanine and a solution comprising 0.5 g of the aromatic polyester resin (No. 1) having a charge transporting function produced in (Example A) and 19 g of tetrahydrofuran were dispersed using a ball-mill and to the resultant dispersion, a charge transporting polymer (the aromatic polyester resin (No. 1)), an acceptor compound represented by Formula (A-1), tetrahydrofuran and a silicone oil (trade name: KF 50; manufactured by Sin-Etsu Chemical Co., Ltd.) were added so that in the dispersion, the contents of the pigment, the aromatic polyester resin (No. 1) having a charge transporting function, the acceptor compound and the silicone oil were respectively 2% by mass, 75.5% by mass, 22.5% by mass and 0.001% by mass, thereby preparing a coating liquid for disposing the photosensitive layer, which had a solid content of 20% by mass. With the thus prepared coating liquid for disposing the photosensitive layer, the above-disposed intermediate layer was coated using a doctor blade and the resultant coating as the photosensitive layer was dried at 120° C. for 20 minutes, thereby disposing the photosensitive layer having a thickness of 20 μm and producing the electrophotographic photoconductor in a single layer composition for a liquid developing (No. 1).

EXAMPLE 14

0.5 g of a X-type metal-free phthalocyanine and a solution comprising 0.5 g of the aromatic polyester resin (No. 2) having a charge transporting function produced in (Example B) and 19 g of tetrahydrofuran were dispersed using a ball-mill and to the resultant dispersion, a charge transporting polymer (the aromatic polyester resin (No. 2)), an acceptor compound represented by Formula (A-1), tetrahydrofuran and a silicone oil (trade name: KF 50; manufactured by Sin-Etsu Chemical Co., Ltd.) were added so that in the dispersion, the contents of the pigment, the aromatic polyester resin (No. 2) having a charge transporting function, the acceptor compound and the silicone oil were respectively 2% by mass, 80% by mass, 18% by mass and 0.001% by mass, thereby preparing a coating liquid for disposing the photosensitive layer, which had a solid content of 20% by mass. With the thus prepared coating liquid for disposing the photosensitive layer, an intermediate layer disposed in substantially the same manner as in Example 13 was coated using a doctor blade and the resultant coating as the photosensitive layer was dried at 120° C. for 20 minutes, thereby disposing the photosensitive layer having a thickness of 20 μm and producing the electrophotographic photoconductor in a single layer composition for a liquid developing (No. 2).

EXAMPLE 15

The electrophotographic photoconductor in a single layer composition for a liquid developing (No. 3) was produced in substantially the same manner as in Example 14, except that the aromatic polyester resin (No. 2) produced in Example B was changed to the aromatic polyester resin (No. 3) produced in Example C.

EXAMPLE 16

The electrophotographic photoconductor in a single layer composition for a liquid developing (No. 4) was produced in substantially the same manner as in Example 14, except that the aromatic polyester resin (No. 2) produced in Example B was changed to the aromatic polyester resin (No. 4) produced in Example D.

EXAMPLE 17

The electrophotographic photoconductor in a single layer composition for a liquid developing (No. 5) was produced in substantially the same manner as in Example 14, except that the acceptor compound represented by Formula (A-1) was changed to the acceptor compound represented by the following Formula (A-3).

(A-3)

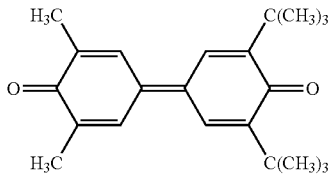

EXAMPLE 18

The electrophotographic photoconductor in a single layer composition for a liquid developing (No. 6) was produced in substantially the same manner as in Example 14, except that the coating liquid for disposing the photosensitive layer was prepared by adding a charge transporting polymer (the aromatic polyester resin (No. 2)), an acceptor compound represented by Formula (A-1), a phenolic compound represented by the following Formula (B-2), tetrahydrofuran and a silicone oil (trade name: KF 50; manufactured by Sin-Etsu Chemical Co., Ltd.) to the dispersion prepared beforehand so that the contents of the pigment, the aromatic polyester resin (No. 2) having a charge transporting function, the acceptor compound, the phenolic compound and the silicone oil were respectively 2% by mass, 75.5% by mass, 20% by mass, 2.5% by mass and 0.001% by mass, thereby preparing a coating liquid for disposing the photosensitive layer, which had a solid content of 20% by mass.

(B-2)

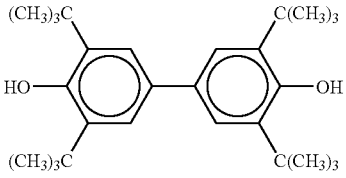

EXAMPLE 19

The electrophotographic photoconductor in a single layer composition for a liquid developing (No. 7) was produced in substantially the same manner as in Example 14, except that the coating liquid for disposing the photosensitive layer was prepared by adding a charge transporting polymer (the aromatic polyester resin (No. 2)), an acceptor compound represented by Formula (A-1), an anti-oxidant (trade name: Sanol LS2626; manufactured by Sankyo Co., Ltd.), tetrahydrofuran and a silicone oil (trade name: KF 50; manufactured by Sin-Etsu Chemical Co., Ltd.) to the dispersion prepared beforehand so that the contents of the pigment, the aromatic polyester resin (No. 2) having a charge transporting function, the acceptor compound, the anti-oxidant and the silicone oil were respectively 2% by mass, 75.5% by mass, 20% by mass, 2.5% by mass and 0.001% by mass, thereby preparing a coating liquid for disposing the photosensitive layer, which had a solid content of 20% by mass.

COMPARATIVE EXAMPLE 4

The support of an aluminum plate was coated with a resin solution in which a polyamide resin (trade name: CM-8000; manufactured by Toray Industries, Inc.) was dissolved in a solvent mixture of methanol/butanol, using a doctor blade and the resultant coating was dried at 100° C. for 5 minutes, thereby disposing the intermediate layer having a thickness of 0.5 μm. Next, 0.5 g of a X-type metal-free phthalocyanine and a solution comprising 0.5 g of a polycarbonate resin Z (trade name: PC-Z; manufactured by Teijin Chemicals Ltd.) and 19 g of tetrahydrofuran were dispersed using a ball-mill and to the resultant dispersion, a charge transporting material having a low molecular mass represented by Formula (D-1), an acceptor compound represented by Formula (A-1), tetrahydrofuran and a silicone oil (trade name: KF 50; manufactured by Sin-Etsu Chemical Co., Ltd.) were added so that in the dispersion, the contents of the pigment, the polycarbonate resin Z, the charge transporting material having a low molecular mass, the acceptor compound and the silicone oil were respectively 2% by mass, 50% by mass, 30% by mass, 18% by mass and 0.001% by mass, thereby preparing a coating liquid for disposing the photosensitive layer, which had a solid content of 20% by mass. With the thus prepared coating liquid for disposing the photosensitive layer, the above-disposed intermediate layer was coated using a doctor blade and the resultant coating as the photosensitive layer was dried at 120° C. for 20 minutes, thereby disposing the photosensitive layer having a thickness of 20 μm and producing the electrophotographic photoconductor in a single layer composition for a liquid developing (Comparative No. 4).

Each of the electrophotographic photoconductors in a single layer composition for a liquid developing produced in Examples 13 to 19 and Comparative Example 4 was subjected to the following measurements under the following conditions and evaluated. The results of the measurement and evaluation are shown in Tables 5 to 11.

(Evaluation and Measurement Conditions)

The test specimen (having a size of 55 mm×60 mm and subjected to an edge-treatment) of each of the electrophotographic photoconductors in a single layer composition for a liquid developing produced in Examples 13 to 19 and Comparative Example 4 was immersed in a carrier solvent Isoper (manufactured by Exxon Chemicals Co., Ltd.) and a silicone oil (trade name: SH200, 50 cSt; manufactured by Toray Dow Silicone Co., Ltd.) respectively at 20° C. in a dark atmosphere having a relative humidity of 50%. At the start of the test, at the end of the immersion in the carrier solvent, and at the end of the immersion in the silicone oil, with respect to the change in the appearance and the photoconductor properties of the photoconductor (visual observation whether the color-change and crack are present or not) each photoconductor was evaluated. With respect to the photoconductor properties, the surface potential V0(V) of the test specimen was measured in such a manner that in an atmosphere having a temperature of 25° C. and a relative humidity of 55%, using a testing apparatus for the static copying paper (trade name: EPA-8200; manufactured by Kawaguchi Electric Works Co., Ltd.), the test specimen was charged with an applying voltage of +6 kV for 20 seconds and was left to stand in a dark place for 20 seconds, then the surface potential V0(V) of the test specimen was measured; and the half decay exposure ($E_{m1/m2}$ (μJ/cm$^2$)) which is required for reducing 800 V of the surface potential of the photoconductor to 400 V was measured in such a manner that to the test specimen, a single-color light having a wavelength of 700 nm was irradiated so that the illuminance at the surface of the test specimen became 2.5 μW/cm$^2$, and then the half decay exposure of the test specimen was measured.

TABLE 5

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 1 | Initial | 554 | 0.36 | | 578 | 0.36 | |
| (Example 13) | 1 day | 546 | 0.36 | none | 575 | 0.36 | none |
| | 7 days | 539 | 0.36 | none | 565 | 0.36 | none |
| | 50 days | 517 | 0.35 | none | 541 | 0.36 | none |

TABLE 6

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 2 | Initial | 985 | 0.38 | | 1007 | 0.38 | |
| (Example 14) | 1 day | 978 | 0.38 | none | 998 | 0.38 | none |
| | 7 days | 973 | 0.37 | none | 993 | 0.38 | none |
| | 50 days | 955 | 0.37 | none | 978 | 0.37 | none |

TABLE 7

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 3 | Initial | 1030 | 0.39 | | 1051 | 0.39 | |
| (Example 15) | 1 day | 1023 | 0.38 | none | 1042 | 0.39 | none |
| | 7 days | 1023 | 0.38 | none | 1032 | 0.39 | none |
| | 50 days | 998 | 0.38 | none | 1007 | 0.38 | none |

TABLE 8

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 4 | Initial | 876 | 0.38 | | 851 | 0.38 | |
| (Example 16) | 1 day | 867 | 0.38 | none | 844 | 0.37 | none |
| | 7 days | 861 | 0.37 | none | 836 | 0.37 | none |
| | 50 days | 833 | 0.37 | none | 811 | 0.37 | none |

TABLE 9

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 5 | Initial | 959 | 0.40 | | 940 | 0.40 | |
| (Example 17) | 1 day | 950 | 0.40 | none | 933 | 0.40 | none |
| | 7 days | 942 | 0.40 | none | 926 | 0.39 | none |
| | 50 days | 913 | 0.39 | none | 901 | 0.39 | none |

TABLE 10

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 6 | Initial | 936 | 0.38 | | 911 | 0.38 | |
| (Example 18) | 1 day | 930 | 0.37 | none | 906 | 0.37 | none |
| | 7 days | 823 | 0.37 | none | 904 | 0.37 | none |
| | 50 days | 905 | 0.37 | none | 890 | 0.36 | none |

TABLE 11

| | | Immersion in Isoper | | | Immersion in Silicone oil | | |
|---|---|---|---|---|---|---|---|
| | | Electrophotography Properties | | Change | Electrophotography Properties | | Change |
| Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 7 | Initial | 923 | 0.39 | | 962 | 0.39 | |
| (Example 19) | 1 day | 903 | 0.38 | none | 954 | 0.39 | none |
| | 7 days | 894 | 0.38 | none | 950 | 0.38 | none |
| | 50 days | 870 | 0.36 | none | 932 | 0.38 | none |

TABLE 12

| | | Immersion in Isoper | | | Immersion in Silicone oil | | |
|---|---|---|---|---|---|---|---|
| | | Electrophotography Properties | | Change | Electrophotography Properties | | Change |
| Comparative Photoconductor | Immersion Time | V0(V) | $E_{m1/m2}$ (μJ/cm$^2$) | in Appearance | V0(V) | $E_{m1/m2}$ (μJ/cm$^2$) | in Appearance |
| No. 4 | Initial | 856 | 0.41 | | 846 | 0.41 | |
| (Comparative Example 4) | 1 day | 1253 | 2.83 | change in color | 853 | 0.40 | none |
| | 7 days | immeasurable | immeasurable | change in color | 891 | 0.42 | none |
| | 50 days | immeasurable | immeasurable | change in color | 957 | 0.46 | change in color |

What is claimed is:

1. An electrophotographic photoconductor comprising:

a support, and a photosensitive layer disposed on the support, wherein the photosensitive layer comprises an aromatic polyester resin comprising a recurring unit represented by the following Formula (I):

Formula (I)

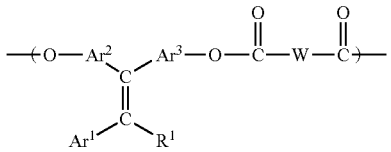

wherein $R^1$ represents any one of a hydrogen atom, an unsubstituted or substituted alkyl group and an unsubstituted or substituted aryl group; $Ar^1$ represents an unsubstituted or substituted aryl group; $Ar^2$ and $Ar^3$ may be the same as or different from each other and represent individually an unsubstituted or substituted arylene group; and W represents an unsubstituted or substituted divalent aromatic group.

2. The electrophotographic photoconductor according to claim 1, wherein an outermost-surface layer of the electrophotographic photoconductor comprises an aromatic polyester resin represented by Formula (I).

3. The electrophotographic photoconductor according to claim 1, wherein the photosensitive layer is in a laminated layer composition comprising a charge generating layer and a charge transporting layer and the charge transporting layer comprises an aromatic polyester resin comprising a recurring unit represented by Formula (I).

4. The electrophotographic photoconductor according to claim 1, wherein the photosensitive layer is in a single layer composition comprising one layer.

5. An electrophotographic photoconductor comprising:

a support, and a photosensitive layer disposed on the support, wherein the photosensitive layer comprises an aromatic polyester resin comprising a recurring unit represented by the following Formula (III):

Formula (III)

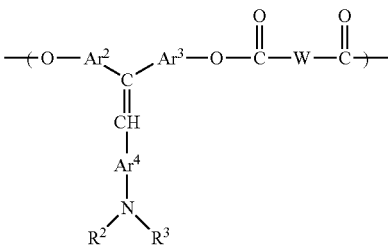

wherein Arand $Ar^3$ may be the same as or different from each other, and represent individually an unsubstituted or substituted arylene group; W represents an unsubstituted or substituted divalent aromatic group; $Ar^4$ represents an unsubstituted or substituted arylene group; $R^2$ and $R^3$ may be the same as or different from each other and represent individually any one of an acyl group, an unsubstituted or substituted alkyl group and an unsubstituted or substituted aryl group.

6. The electrophotographic photoconductor according to claim 5, wherein an outermost-surface layer of the electrophotographic photoconductor comprises an aromatic polyester resin represented by Formula (III).

7. The electrophotographic photoconductor according to claim 5, wherein the photosensitive layer is in a laminated layer composition comprising a charge generating layer and a charge transporting layer and the charge transporting layer comprises an aromatic polyester resin represented by Formula (III).

8. The electrophotographic photoconductor according to claim 5, wherein the photosensitive layer is in a single layer composition comprising one layer.

9. An electrophotographic photoconductor comprising:

a support, and a photosensitive layer disposed on the support, wherein the photosensitive layer comprises an aromatic polyester resin comprising a recurring unit represented by the following Formula (IV):

Formula (IV)

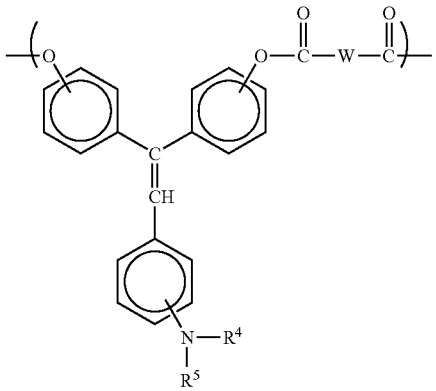

wherein $R^4$ and $R^5$ may be the same as or different from each other and represent individually any one of an acyl group, an unsubstituted or substituted alkyl group and an unsubstituted or substituted aryl group; and W represents an unsubstituted or substituted divalent aromatic group.

10. The electrophotographic photoconductor according to claim 9, an outermost-surface layer of the electrophotographic photoconductor comprises an aromatic polyester resin represented by Formula (IV).

11. The electrophotographic photoconductor according to claim 9, wherein the photosensitive layer is in a laminated layer composition comprising a charge generating layer and a charge transporting layer and the charge transporting layer comprises an aromatic polyester resin represented by Formula (IV).

12. The electrophotographic photoconductor according to claim 9, wherein the photosensitive layer is in a single layer composition comprising one layer.

13. An electrophotographic photoconductor comprising:

a support, and a photosensitive layer in a single layer composition disposed on the support directly or through an intermediate layer, wherein the photosensitive layer comprises a charge generating substance, a charge transporting substance and an acceptor compound and the charge transporting substance comprises an aromatic polyester resin comprising a recurring unit represented by the following Formula (III):

Formula (III)

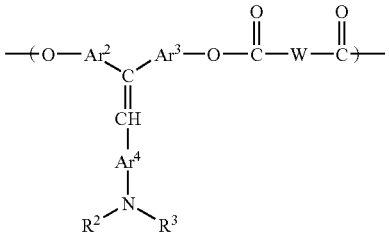

wherein $Ar^2$ and $Ar^3$ may be the same as or different from each other, and represent individually an unsubstituted or substituted arylene group; W represents an unsubstituted or substituted divalent aromatic group; $Ar^4$ an unsubstituted or substituted arylene group; $R^2$ and $R^3$ may be the same as or different from each other and represent individually any one of an acyl group, an unsubstituted or substituted alkyl group and an unsubstituted or substituted aryl group.

14. The electrophotographic photoconductor according to claim 13, wherein the acceptor compound is a 2,3-diphenylindene compound represented by the following Formula (F1):

Formula (F1)

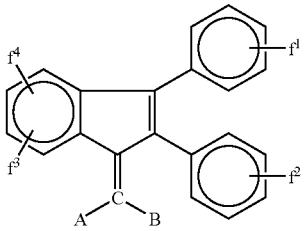

wherein $f^1$, $f^2$, $f^3$ and $f^4$ represent individually any one of a hydrogen atom, a halogen atom, an unsubstituted or substituted alkyl group, a cyano group and a nitro group; A and B may be the same as or different from each other and represent individually any one of a hydrogen atom, an unsubstituted or substituted aryl group, a cyano group, an alkoxycarbonyl group and an aryloxycarbonyl group.

15. The electrophotographic photoconductor according to claim 13, wherein the photosensitive layer comprises a phenolic compound represented by the following Formula (G1):

Formula (G1)

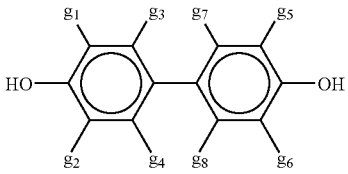

wherein $g_1$ to $g_8$ may be the same as or different from each other and represent individually any one of a hydrogen atom, an unsubstituted or substituted alkyl group, an unsubstituted or substituted alkoxycarbonyl group, an unsubstituted or substituted aryl group, and an unsubstituted or substituted alkoxy group.

16. An electrophotographic photoconductor comprising:

a support, and a photosensitive layer in a single layer composition disposed on the support directly or through an intermediate layer, wherein the photosensitive layer comprises a charge generating substance, a charge transporting substance and an acceptor compound and the charge transporting substance comprises an aromatic polyester resin comprising a recurring unit represented by the following Formula (IV):

Formula (IV)

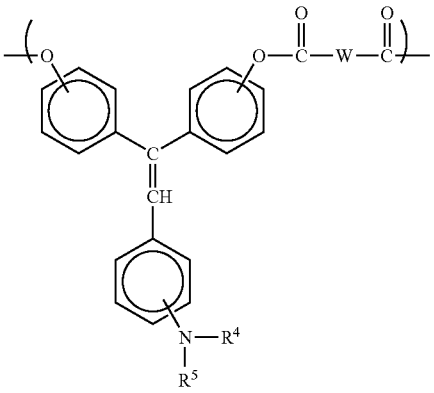

wherein $R^4$ and $R^5$ may be the same as or different from each other and represent individually any one of an acyl group, an unsubstituted or substituted alkyl group and an unsubstituted or substituted aryl group; and W represents an unsubstituted or substituted divalent aromatic group.

17. The electrophotographic photoconductor according to claim 16, wherein the acceptor compound is a 2,3-diphenylindene compound represented by the following Formula (F1):

Formula (F1)

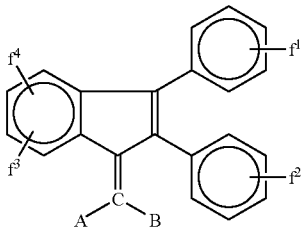

wherein f1, $f^2$, $f^3$ and $f^4$ represent individually the same as defined in claim 14.

18. The electrophotographic photoconductor according to claim 16, wherein the photosensitive layer comprises a phenolic compound represented by the following Formula (G1):

Formula (G1)

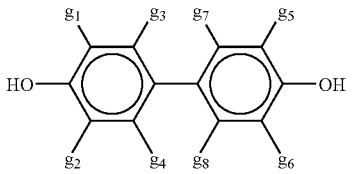

wherein $g_1$ to $g_8$ represent individually the same as defined in claim 15.

19. An image forming apparatus comprising:

an electrophotographic photoconductor, an electrostatic-latent-image forming unit configured to form an electrostatic-latent-image on the electrophotographic photoconductor, a developing unit configured to develop the electrostatic-latent-image using a toner to form a visual image, a transferring unit configured to transfer the visual image to a recording medium, and a fixing unit configured to fix a transferred image to the recording medium, wherein the electrophotogarphic photoconductor comprises a support and a photosensitive layer disposed on the support and the photosensitive layer comprises an aromatic polyester resin comprising a recurring unit represented by the following Formula (I):

Formula (I)

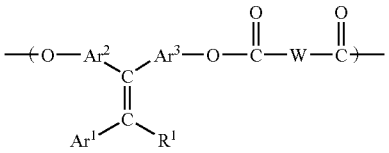

wherein $R^1$ represents any one of a hydrogen atom, an unsubstituted or substituted alkyl group and an unsubstituted or substituted aryl group; $Ar^1$ represents an unsubstituted or substituted aryl group; $Ar^2$ and $Ar^3$ may be the same as or different from each other and represent individually an unsubstituted or substituted arylene group; and W represents an unsubstituted or substituted divalent aromatic group.

20. An image forming apparatus comprising:

an electrophotographic photoconductor, an electrostatic-latent-image forming unit configured to form an electrostatic-latent-image on the electrophotographic photoconductor, a developing unit configured to develop the electrostatic-latent-image using a toner to form a visual image, a transferring unit configured to transfer the visual image to a recording medium, and a fixing unit configured to fix a transferred image to the recording medium, wherein the electrophotogarphic photoconductor comprises a support and a photosensitive layer disposed on the support and the photosensitive layer comprises an aromatic polyester resin comprising a recurring unit represented by the following Formula (III):

Formula (III)

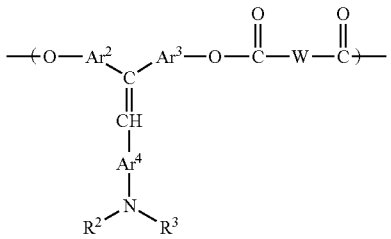

wherein $Ar^2$ and $Ar^3$ may be the same as or different from each other, and represent individually an unsubstituted or substituted arylene group; W represents an unsubstituted or substituted divalent aromatic group; $Ar^4$ represents an unsubstituted or substituted arylene group; $R^2$ and $R^3$ may be the same as or different from each other and represent individually any one of an acyl group, an unsubstituted or substituted alkyl group and an unsubstituted or substituted aryl group.

21. An image forming apparatus comprising:

an electrophotographic photoconductor, an electrostatic-latent-image forming unit configured to form an electrostatic-latent-image on the electrophotographic photoconductor, a developing unit configured to develop the electrostatic-latent-image using a toner to form a visual image, a transferring unit configured to transfer the visual image to a recording medium, and a fixing unit configured to fix a transferred image to the recording medium, wherein the electrophotogarphic photoconductor comprises a support, and a photosensitive layer disposed on the support and the photosensitive layer comprises an aromatic polyester resin comprising a recurring unit represented by the following Formula (IV):

Formula (IV)

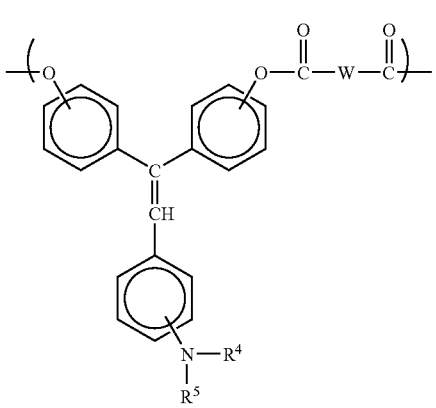

wherein $R^4$ and $R^5$ may be the same as or different from each other and represent individually any one of an acyl group, an unsubstituted or substituted alkyl group and an unsubstituted or substituted aryl group; and W represents an unsubstituted or substituted divalent aromatic group.

22. An image forming apparatus comprising:

an electrophotographic photoconductor, an electrostatic-latent-image forming unit configured to form an electrostatic-latent-image on the electrophotographic photoconductor, a developing unit configured to develop the electrostatic-latent-image using a toner to form a visual image, a transferring unit configured to transfer the visual image to a recording medium, and a fixing unit configured to fix a transferred image to the recording medium, wherein the electrophotographic photoconductor comprises a support, and a photosensitive layer in a single layer composition disposed on the support directly or through an intermediate layer, wherein the photosensitive layer comprises a charge generating substance, a charge transporting substance and an acceptor compound and the charge transporting substance comprises an aromatic polyester resin comprising a recurring unit represented by the following Formula (III):

Formula (III)

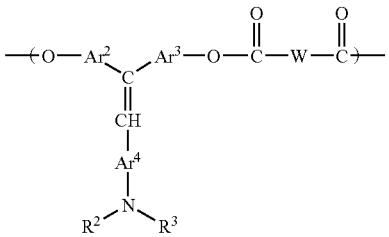

wherein $Ar^2$ and $Ar^3$ may be the same as or different from each other and represent individually an unsubstituted or substituted arylene group; W represents an unsubstituted or substituted divalent aromatic group; $Ar^4$ represents an unsubstituted or substituted arylene group; $R^2$ and $R^3$ may be the same as or different from each other, and represent individually any one of an acyl group, an unsubstituted or substituted alkyl group and an unsubstituted or substituted aryl group.

23. An image forming apparatus comprising:

an electrophotographic photoconductor, an electrostatic-latent-image forming unit configured to form an electrostatic-latent-image on the electrophotographic photoconductor, a developing unit configured to develop the electrostatic-latent-image using a toner to form a visual image, a transferring unit configured to transfer the visual image to a recording medium, and a fixing unit configured to fix a transferred image to the recording medium, wherein the electrophotographic photoconductor comprises a support, and a photosensitive layer in a single layer composition disposed on the support directly or through an intermediate layer, wherein the photosensitive layer comprises a charge generating substance, a charge transporting substance and an acceptor compound and the charge transporting substance comprises an aromatic polyester resin comprising a recurring unit represented by the following Formula (IV):

Formula (IV)

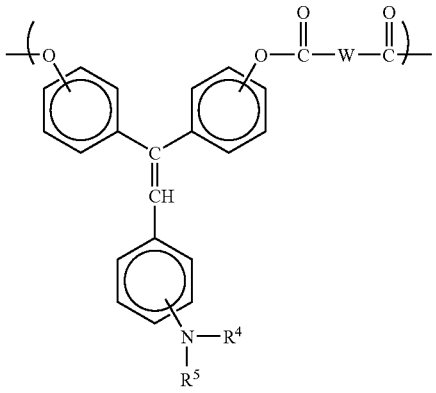

wherein $R^4$ and $R^5$ may be the same as or different from each other and represent individually any one of an acyl group, an unsubstituted or substituted alkyl group and an unsubstituted or substituted aryl group; and W represents an unsubstituted or substituted divalent aromatic group.

* * * * *